US005369217A

United States Patent [19]

Yamashita et al.

[11] Patent Number: 5,369,217

[45] Date of Patent: Nov. 29, 1994

[54] RHYTHM CREATING SYSTEM FOR CREATING A RHYTHM PATTERN FROM SPECIFYING INPUT DATA

[75] Inventors: Yuji Yamashita; Katsuhiro Toyota, both of Osaka, Japan

[73] Assignee: Roland Corporation, Osaka, Japan

[21] Appl. No.: 942,612

[22] Filed: Sep. 10, 1992

[30] Foreign Application Priority Data

| | | | |
|---|---|---|---|
| Jan. 16, 1992 | [JP] | Japan | 4-005679 |
| Jan. 16, 1992 | [JP] | Japan | 4-005680 |
| Jan. 16, 1992 | [JP] | Japan | 4-005682 |

[51] Int. Cl.[5] ..... G10H 7/00; G10H 1/40

[52] U.S. Cl. ..... 84/611; 84/635

[58] Field of Search ..... 84/611, 635, 651, 667

[56] References Cited

U.S. PATENT DOCUMENTS

| | | | |
|---|---|---|---|
| 4,217,806 | 8/1980 | Sakai et al. | 84/635 |
| 4,972,755 | 11/1990 | Tajima et al. | 84/667 |
| 5,099,740 | 3/1992 | Minamitaka | 84/651 |
| 5,138,928 | 8/1992 | Nakajima et al. | 84/635 |
| 5,177,313 | 1/1993 | Miyamoto | 84/635 X |

*Primary Examiner*—William M. Shoop, Jr.

*Assistant Examiner*—Jeffrey W. Donels

*Attorney, Agent, or Firm*—Adduci, Mastriani, Schaumberg & Schill

[57] ABSTRACT

Rhythm patterns are created by producing primitive data not having any fixed meaning and by associating the primitive data with desired creating parameters among a plurality of creating parameters for specifying meanings of the primitive data. The rhythm patterns may be created by storing a rule data base for associating a plurality of parameters specifying the features of rhythm and a plurality of rhythm patterns beforehand in a memory, entering the plurality of parameters, making reference to the rule data base on the basis of the plurality of input parameters, and creating the desired rhythm patterns by an inference system. It is also possible to create the rhythm patterns by extracting predetermined choices of at least some of a plurality of parameters specifying the features of desired rhythm for each part of a piece of music, creating rhythm patterns respectively for the parts of the piece of music from the choices extracted from the parameters for the parts of the piece of music and integrating the rhythm patterns for the entire piece of music.

3 Claims, 30 Drawing Sheets

| Rule number | Timbre | Creating parameter | Primitive data |
|---|---|---|---|
| 1 | DRY | 1 | 2 |
| | | 2 | 4 |
| | | 5 | 1 |
| 2 | POWER | 3 | 4 |
| | | 1 | 2 |
| | | 3 | 3 |
| 3 | REVERB | 4 | 1 |
| | | 6 | 2 |
| | | 4 | 2 |
| . | | . | . |
| . | | . | . |

Fig.4

| Creating parameter | Contents |
|---|---|
| 1 | 1 = C-HIHAT 0 = Nonsounding Musical length = 2 Beats (Primitive data) 1 Bar = 4 Beats (4/4 Time) |
| 2 | 1 = Crash cymbals、 0 = Nonsounding Musical length = 4 Beats (Primitive data), 1 Bar = 4 Beats (4/4 Time) |
| 3 | 1 = Snare drum 0 = Kick Musical length = 4 Beats (Primitive data) 1 Bar = 4 Beats (4/4 Time) |
| . . | |

Fig. 5

| Primitive data | Contents |
|---|---|
| 0 | 0 0 0 0 |
| 1 | 0 0 0 1 |
| 2 | 0 0 1 0 |
| 3 | 0 0 1 1 |
| . | . |
| . | . |

Fig.6

Input parameter

GENRE=ROCK
Ptn=BASIC
LENGTH=4
LEVEL=2
IDEA=2
METER=4/4

Fig.11

Inference work area

| (A)Before inference | (B)After inference |
|---|---|
| GENRE=ROCK | GENRE=ROCK |
| Ptn=BASIC | Ptn=BASIC |
| LENGTH=4 | LENGTH=4 |
| LEVEL=2 | LEVEL=2 |
| IDEA=2 | IDEA=2 |
| METER=4/4 | METER=4/4 |
| VARI=1 | VARI=1 |
| | ALWAYSO |
| | ROCKO |
| | LOAD=KICK:TYPE=8:ID=95 |
| | LOAD=SNARE:TYPE=8:ID=22 |
| | LOAD=HIHAT:TYPE=8:ID=FF |
| | DEL=HIHAT:TYPE=8:ID=AA |
| | 7TH:DEL=HIHAT:TYPE=8:ID=01 |
| | 7TH:ADD=OHIHAT:TYPE=8:ID=01 |

Fig.12

```
*1      if ROCK then ALWAYS0
*2      if BASIC and if ALWAYS0 then ROCK0
        if FILLIN and if ALWAYS0 then ROCK1
        if INTOR0 and if ALWAYS0 then ROCK2

ROCK0   if ALWAYS0 then LOAD=HIHAT: TYPE=8: ID=FF
        if LEVEL=1 then LOAD=KICK: TYPE=8: ID=8C
        if LEVEL=2 then LOAD=KICK: TYPE=8: ID=95
        if LEVEL=3 then LOAD=KICK: TYPE=8: ID=85 ID=05
        if LEVEL=4 then LOAD=KICK: TYPE=8: ID=C8 ID=8C
        if LEVEL=5 then LOAD=KICK: TYPE=8: ID=8C ID=CD
        if LEVEL=6 then LOAD=KICK: TYPE=8: ID=99
        if LEVEL=7 then LOAD=KICK: TYPE=8: ID=98
        if LEVEL=8 then LOAD=KICK: TYPE=8: ID=AA
        if LEVEL=1-7 then LOAD=SNARE: TYPE=8: ID=22
        if LEVEL=4 then ADD=SNARE: TYPE=8: ID=12: ID=02
        if LEVEL=5 then ADD=SNARE: TYPE=16: ID=01: ID=40
        if LEVEL=6 then ADD=SNARE: TYPE=8: ID=00: ID=04
        if LEVEL=7 then ADD=SNARE: TYPE=8: ID=04
        if LEVEL=8 then ADD=SNARE: TYPE=8: ID=AA
        if LEVEL=6 then SWAP=SNARE*FTOM: TYPE=8: ID=02: ID=03
        if LEVEL=7 then SWAP=SNARE*HTOM: TYPE=8: ID=20
        if LEVEL=7 then SWAP=SNARE*MTOM: TYPE=8: ID=04
        if LEVEL=7 then SWAP=SNARE*LTOM: TYPE=8: ID=02
        if LEVEL=7 then SWAP=SNARE*FTOM: TYPE=8: ID=01
        if IDEA=2 then DEL=HIHAT: TYPE=8: ID=AA
        if IDEA=3 then SWAP=HIHAT*OHIHAT TYPE=8: ID=55
        if IDEA=4 then SWAP=HIHAT*OHIHAT TYPE=8: ID=44
        if IDEA=5 then SWAP=HIHAT*RIDE: TYPE=8: ID=FF
        if IDEA=6-7 then DEL=HIHAT: TYPE=8: ID=55
        if IDEA=6 then SWAP=HIHAT≠BELL: TYPE=8: ID=AA
        if IDEA=7 then SWAP=HIHAT≠SPLSH: TYPE=8: ID=AA
        if IDEA=5-7 then ADD=PHIHAT: TYPE=8: ID=AA
        if IDEA=8 then ADD=PHIHAT: TYPE=16: ID=FF
        if IDEA=8 then CHG=PHIHAT: SNARE=RIDE
        if VARI=0-1 then 7TH: DEL=HIHAT: TYPE=8: ID=01
        if VARI=0-1 then 7TH: ADD=OHIHAT: TYPE=8: ID=01
        if LEVEL=1-7 and if VARI=3 then LOAD=SNARE: TYPE=8: ID=02
        if LEVEL=1-7 and if VARI=4 then LOAD=SNARE: TYPE=8: ID=02
        if VARI=2 then 7TH: LOAD=KICK: TYPE=8: ID=D4
        if VARI=3 then 8TH: LOAD=KICK: TYPE=16: ID=A2
        if VARI=5 then 8TH: ADD=SNARE: TYPE=16: ID=2A
        if VARI=6 then ADD=SNARE: TYPE=16: ID=00: ID=00: ID=00: ID=4B
        if VARI=7 then ADD=SNARE: TYPE=16: ID=43: ID=43: ID=03: ID=43
ROCK0END
```

Fig.13

Pattern creation instruction

```
LOAD=KICK:TYPE=8:ID=95
LOAD=SNARE:TYPE=8:ID=22
LOAD=HIHAT:TYPE=8:ID=FF
DEL=HIHAT:TYPE=8:ID=AA
7TH:DEL=HIHAT:TYPE=8:ID=01
7TH:ADD=OHIHAT:TYPE=8:ID=01
```

Fig.14

| | | | | | | | | |
|---|---|---|---|---|---|---|---|---|
| LOAD=HIHAT: | 1111 | 1111 | 1111 | 1111 | 1111 | 1111 | 1111 | 1111 |
| DEL=HIHAT: | 1010 | 1010 | 1010 | 1010 | 1010 | 1010 | 1010 | 1010 |
| 7TH:DEL=HIHAT: | | | | | | | 0000 | 0001 |
| 7TH:ADD=OHIHAT: | | | | | | | 0000 | 0001 |
| HIHAT: | 0101 | 0101 | 0101 | 0101 | 0101 | 0101 | 0101 | 0100 |
| OHIHAT: | 0000 | 0000 | 0000 | 0000 | 0000 | 0000 | 0000 | 0001 |
| LOAD=SNARE: | 0010 | 0010 | 0010 | 0010 | 0010 | 0010 | 0010 | 0010 |
| SNARE: | 0010 | 0010 | 0010 | 0010 | 0010 | 0010 | 0010 | 0010 |
| LOAD=KICK: | 1001 | 0101 | 1001 | 0101 | 1001 | 0101 | 1001 | 0101 |
| KICK: | 1001 | 0101 | 1001 | 0101 | 1001 | 0101 | 1001 | 0101 |

Fig.15

```
GENRE=ROCK
Ptn TYPE=BASIC
LENGTH=4
LEVEL=7
IDEA=6
VARI=1
```

Fig.17(A)

```
GENRE=ROCK
Ptn=TYPE=BASIC
LENGTH=4
LEVEL=7
IDEA=6
VARI=1
ALWAYS0
GOTO=ROCK0
LOAD=HIHAT : TYPE=8 : ID=FF
LOAD=KICK : TYPE=8 : ID=98
LOAD=SNARE : TYPE=8 : ID=22
ADD=SNARE : TYPE=8 : ID=04
SWAP=SNARE*HTOM : TYPE=8 : ID=20
SWAP=SNARE*MTOM : TYPE=8 : ID=04
SWAP=SNARE*LTOM : TYPE=8 : ID=02
SWAP=SNARE*FTOM : TYPE=8 : ID=01
DEL=HIHAT : TYPE=8 : ID=55
SWAP=HIHAT*BELL : TYPE=8 : ID=AA
ADD=PHIHAT : TYPE=8 : ID=AA
7TH : DEL=HIHAT : TYPE=8 : ID=01
7TH : ADD=OHIHAT : TYPE=8 : ID=01
```

Fig.17(B)

| | | | | | |
|---|---|---|---|---|---|
| LOAD=HIHAT: | 1111 1111 | 1111 1111 | 1111 1111 | 1111 1111 | |
| DEL=HIHAT: | 0101 0101 | 0101 0101 | 0101 0101 | 0101 0101 | |
| HIHAT: | 1010 1010 | 1010 1010 | 1010 1010 | 1010 1010 | |
| SWAP=HIHIAT*BELL | 1010 1010 | 1010 1010 | 1010 1010 | 1010 1010 | (*1) |
| HIHAT & (*1): | 1010 1010 | 1010 1010 | 1010 1010 | 1010 1010 | (*2) |
| HIHAT - (*2): | 0000 0000 | 0000 0000 | 0000 0000 | 0000 0000 | |
| BELL + (*2): | 1010 1010 | 1010 1010 | 1010 1010 | 1010 1010 | |
| 7TH:DEL=HIHIAT: | | | | 0000 0001 | |
| HIHAT: | 0000 0000 | 0000 0000 | 0000 0000 | 0000 0000 | |
| 7TH:ADD=OHIHAT: | | | | 0000 0001 | |
| OHIHAT: | 0000 0000 | 0000 0000 | 0000 0000 | 0000 0001 | |
| ADD=PHIHAT: | 1010 1010 | 1010 1010 | 1010 1010 | 1010 1010 | |
| PHIHAT: | 1010 1010 | 1010 1010 | 1010 1010 | 1010 1010 | |
| LOAD=SNARE: | 0010 0010 | 0010 0010 | 0010 0010 | 0010 0010 | |
| ADD=SNARE: | 0000 0000 | 0000 0000 | 0000 0000 | 0000 0100 | |
| SNARE: | 0010 0110 | 0010 0110 | 0010 0110 | 0010 0110 | |
| SWAP=SNARE*HTOM: | 0010 0000 | 0010 0000 | 0010 0000 | 0010 0000 | (*3) |
| SNARE & (*3): | 0010 0000 | 0010 0000 | 0010 0000 | 0010 0000 | (*4) |
| SNARE - (*4): | 0000 0110 | 0000 0110 | 0000 0110 | 0000 0110 | |
| HTOM + (*4): | 0010 0000 | 0010 0000 | 0010 0000 | 0010 0000 | |
| SWAP=SNARE*MTOM: | 0000 0100 | 0000 0100 | 0000 0100 | 0000 0100 | (*5) |
| SNARE & (*5): | 0000 0100 | 0000 0100 | 0000 0100 | 0000 0100 | (*6) |
| SNARE - (*6): | 0000 0010 | 0000 0010 | 0000 0010 | 0000 0010 | |
| MTOM + (*6): | 0000 0100 | 0000 0100 | 0000 0100 | 0000 0100 | |
| SWAP=SNARE*LTOM: | 0000 0010 | 0000 0010 | 0000 0010 | 0000 0010 | (*7) |
| SNARE & (*7): | 0000 0010 | 0000 0010 | 0000 0010 | 0000 0010 | (*8) |
| SNARE - (*8): | 0000 0000 | 0000 0000 | 0000 0000 | 0000 0000 | |
| LTOM + (*8): | 0000 0010 | 0000 0010 | 0000 0010 | 0000 0010 | |
| SWAP=SNARE*FTOM: | 0000 0001 | 0000 0001 | 0000 0001 | 0000 0001 | (*9) |
| SNARE & (*9): | 0000 0000 | 0000 0000 | 0000 0000 | 0000 0000 | (*10) |
| SNARE - (*10): | 0000 0000 | 0000 0000 | 0000 0000 | 0000 0000 | |
| FTOM + (*10): | 0000 0000 | 0000 0000 | 0000 0000 | 0000 0000 | |
| LOAD=KICK: | 1001 1000 | 1001 1000 | 1001 1000 | 1001 1000 | |
| KICK: | 1001 1000 | 1001 1000 | 1001 1000 | 1001 1000 | |
| BELL: | 1010 1010 | 1010 1010 | 1010 1010 | 1010 1010 | |
| OHIHAT: | 0000 0000 | 0000 0000 | 0000 0000 | 0000 0001 | |
| PHIHAT: | 1010 1010 | 1010 1010 | 1010 1010 | 1010 1010 | |
| HTOM: | 0010 0000 | 0010 0000 | 0010 0000 | 0010 0000 | |
| MTOM: | 0000 0100 | 0000 0100 | 0000 0100 | 0000 0100 | |
| LTOM: | 0000 0010 | 0000 0010 | 0000 0010 | 0000 0010 | |
| KICK: | 1001 1000 | 1001 1000 | 1001 1000 | 1001 1000 | |
| (SNARE: | 0000 0000 | 0000 0000 | 0000 0000 | 0000 0000) | |
| (FTOM: | 0000 0000 | 0000 0000 | 0000 0000 | 0000 0000) | |

Fig.18

```
GENRE=ROCK
Ptn TYPE=BASIC
LENGTH=4
LEVEL=2
IDEA=2
VARI=3
```

Fig.20(A)

```
GENRE=ROCK
Ptn TYPE=BASIC
LENGTH=4
LEVEL=2
IDEA=2
VARI=3
ALWAYS0
ROCK0
LOAD=KICK : TYPE=8 : ID=95
LOAD=SNARE : TYPE=8 : ID=22
LOAD=HIHAT : TYPE=8 : ID=FF
DEL=HIHAT : TYPE=8 : ID=AA
LOAD=SNARE : TYPE=8 : ID=02
8TH : LOAD=KICK : TYPE=16 : ID=A2
```

Fig.20(B)

| | | | | | | | | |
|---|---|---|---|---|---|---|---|---|
| LOAD=SNARE: | 0010 | 0010 | 0010 | 0010 | 0010 | 0010 | 0010 | 0010 |
| LOAD=SNARE: | 0000 | 0010 | 0000 | 0010 | 0000 | 0010 | 0000 | 0010 |
| SNARE: | 0000 | 0010 | 0000 | 0010 | 0000 | 0010 | 0000 | 0010 |
| LOAD=KICK: | 1001 | 0101 | 1001 | 0101 | 1001 | 0101 | 1001 | 0101 |
| 8TH:LOAD=KICK: | | | | | | | | 10100010 |
| KICK: | 1001 | 0101 | 1001 | 0101 | 1001 | 0101 | 1001 | 0101 |

Fig.21

[Fact]

| Genre | Rock |
|---|---|
| Level | 1 |

| Part name | Number of bars |
|---|---|
| INTRO | 4 |
| A | 4 |
| A' | 4 |
| B | 8 |
| C | 8 |
| B' | 8 |
| C' | 16 |
| ENDING | 2 |

Fig.26

```
  1:IF PART = A   THEN  IDEA = 1
  2:IF PART = A'  THEN  IDEA = 2
  3:IF PART = B   THEN  IDEA = 3
  4:IF PART = B'  THEN  IDEA = 4
  5:IF PART = C   THEN  IDEA = 5
  6:IF PART = C'  THEN  IDEA = 6
   :        :
  a:IF PART = INTRO AND NUMBER OF BARS = 1  THEN IDEA = 0
a+1:IF PART = INTRO AND NUMBER OF BARS = 2  THEN IDEA = 1
a+2:IF PART = INTRO AND NUMBER OF BARS = 3  THEN IDEA = 2
a+3:IF PART = INTRO AND NUMBER OF BARS = 4  THEN IDEA = 3
   :        :
  b:IF PART = ENDING AND NUMBER OF BARS = 1  THEN IDEA = 0
b+1:IF PART = ENDING AND NUMBER OF BARS = 2  THEN IDEA = 1
b+2:IF PART = ENDING AND NUMBER OF BARS = 3  THEN IDEA = 2
   :        :
  c:IF GENRE = ROCK  THEN TIME = 8/8
c+1:IF GENRE = WALTZ  THEN TIME = 6/8
c+2:IF GENRE = BOUGIE THEN TIME = 12/8
   :        :
  d:IF NUMBER OF BARS OF THE PART > 3   THEN JOB1
   :        :
  e:IF JOB1 IS EXECUTED  THEN JOB2
   :        :
  f JOB1  SUBTRACT 1 FROM THE NUMBER OF BARS OF THE PART
f+1:INSERT ONE BAR OF Fill IN THE PARAMETER OF THE PART
    AFTER JOB2 PART
   ⋮        ⋮
```

Fig.27

Data Obtained through Inference by Song Creating Unit

| | | |
|---|---|---|
| INTRO | => | GENRE = ROCK, LEVEL = 1, NUMBER OF BARS = 3, IDEA = 3, TIME = 8/8 |
| FILL I | => | GENRE = ROCK, LEVEL = 1, NUMBER OF BARS = 1, IDEA = 3, TIME = 8/8 |
| A | => | GENRE = ROCK, LEVEL = 1, NUMBER OF BARS = 3, IDEA = 1, TIME = 8/8 |
| FILL A | => | GENRE = ROCK, LEVEL = 1, NUMBER OF BARS = 1, IDEA = 1, TIME = 8/8 |
| A' | => | GENRE = ROCK, LEVEL = 1, NUMBER OF BARS = 3, IDEA = 2, TIME = 8/8 |
| FILL A' | => | GENRE = ROCK, LEVEL = 1, NUMBER OF BARS = 1, IDEA = 2, TIME = 8/8 |
| B | => | GENRE = ROCK, LEVEL = 1, NUMBER OF BARS = 7, IDEA = 3, TIME = 8/8 |
| FILL B | => | GENRE = ROCK, LEVEL = 1, NUMBER OF BARS = 1, IDEA = 3, TIME = 8/8 |
| C | => | GENRE = ROCK, LEVEL = 1, NUMBER OF BARS = 7, IDEA = 5, TIME = 8/8 |
| FILL C | => | GENRE = ROCK, LEVEL = 1, NUMBER OF BARS = 1, IDEA = 5, TIME = 8/8 |
| B' | => | GENRE = ROCK, LEVEL = 1, NUMBER OF BARS = 7, IDEA = 4, TIME = 8/8 |
| FILL B' | => | GENRE = ROCK, LEVEL = 1, NUMBER OF BARS = 1, IDEA = 4, TIME = 8/8 |
| C' | => | GENRE = ROCK, LEVEL = 1, NUMBER OF BARS = 15, IDEA = 6, TIME = 8/8 |
| FILL C' | => | GENRE = ROCK, LEVEL = 1, NUMBER OF BARS = 1, IDEA = 6, TIME = 8/8 |
| ENDING | => | GENRE = ROCK, LEVEL = 1, NUMBER OF BARS = 2, IDEA = 1, TIME = 8/8 |

Fig.28

Pattern Creating Rules,

```
 1:1F PART=INTRO          THEN COUNT
 2:1F PART=FILL           AND LEVEL=1       THEN SNARE  1
 3:1F PART=FILL           AND LEVEL=2       THEN SNARE  2
 4:1F PART=FILL           AND LEVEL=3       THEN SNARE  3
 5:1F PART=FILL           AND IDEA=1        THEN SNARE & KICK 1
 6:1F PART=FILL           AND IDEA=2        THEN SNARE & KICK 2
 7:1F PART=FILL           AND IDEA=3        THEN SNARE & KICK 3
 8:1F PART=FILL           AND IDEA=4        THEN SNARE & TOM 1
 9:1F PART=FILL           AND IDEA=5        THEN SNARE & TOM 2
10:1F PART=BASIC          AND LEVEL=1       THEN SNARE 5
11:1F PART=BASIC          AND LEVEL=2       THEN SNARE 6
12:1F PART=BASIC          AND LEVEL=3       THEN SNARE 7
13:1F PART=BASIC          AND IDEA=1        THEN KICK 1
14:1F PART=BASIC          AND IDEA=2        THEN KICK 2
15:1F PART=BASIC          AND IDEA=3        THEN KICK 3
16:1F PART=BASIC          AND IDEA=4        THEN KICK 4
17:1F PART=BASIC          AND IDEA=5        THEN KICK 5
18:1F GENRE=ROCK          THEN 8 BEAT
19:1F GENRE=JAZZ          THEN 4 BEAT
20:1F GENRE=DISCO         THEN 8 BEAT
21:1F GENRE=FUNK          THEN 16 BEAT
22:1F  8 BEAT AND PART=BASIC AND LEVEL=1  THEN HIHAT 1
23:1F  8 BEAT AND PART=BASIC AND LEVEL=2  THEN HIHAT 2
24:1F  4 BEAT             AND LEVEL=1     THEN RIDE  1
25:1F  4 BEAT             AND LEVEL=2     THEN HIHAT 3
26:1F  COUNT              THEN RIM =8888
27:1F  KICK 1             THEN KICK=8080
28:1F  KICK 2             THEN KICK=A080
29:1F  KICK 3             THEN KICK=8282
30:1F  KICK 4             THEN KICK=8000
31:1F  KICK 5             THEN KICK=A222
32:1F  CYMBALS 1          THEN CASH=8000
33:1F  SNARE 1            THEN SNARE=080A
34:1F  SNARE 2            THEN SNARE=0AAA
35:1F  SNARE 3            THEN SNARE=2AFF
36:1F  SNARE 4            THEN SNARE=FFFF
37:1F  SNARE 5            THEN SNARE=0808
38:1F  SNARE 6            THEN SNARE=0A08
39:1F  SNARE 7            THEN SNARE=0948
40:1F  SNARE & KICK 1     THEN SWAP SNARE & KICK=0820
41:1F  SNARE & KICK 2     THEN SWAP SNARE & KICK=2222
42:1F  SNARE & KICK 3     THEN SWAP SNARE & KICK=3330
43:1F  SNARE & TOM 1      THEN SWAP SNARE & HTOM=00E0
44:1F  SNARE & TOM 1      THEN SWAP SNARE & HTOM=000E
45:1F  SNARE & TOM 2      THEN SWAP SNARE & HTOM=C000
46:1F  SNARE & TOM 2      THEN SWAP SNARE & HTOM=0C00
47:1F  SNARE & TOM 2      THEN SWAP SNARE & HTOM=00C0
48:1F  HIHAT 1            THEN CHIHAT=AAAA
49:1F  HIHAT 1            THEN CHIHAT=8888
50:1F  HIHAT 2            THEN CHIHAT=2222
51:1F  HIHAT 3            THEN CHIHAT=8585
52:1F  RIDE 1             THEN RIDE=8585
 .          .
 .          .
 .          .
```

Fig.29

Fig. 30

DATA OBTAINED THROUGH INFERENCE BY PATTERN CREATING UNIT

INTRO => RIM = 8888

FILL I => SNARE = 080A, SWAP SNARE & KICK = 3330

A => KICK=8080, SNARE=0808, CHIHAT = AAAA

FILL A => SNARE = 080A, SWAP SNARE & KICK = 0820

B => KICK = 8282, SNARE = 0808, CHIHAT = AAAA

FILL B => SNARE = 080A, SWAP SNARE & KICK = 3330

⋮

(a) INTRO => RIM : 8888 → [1000100010001000]

— — — — — — —

(b) FILL A => SNARE : 080A → [0000100000001010]

SWAP : 0820 → [0000100000100000]

↓

SNARE : [0000000000001010]

KICK : [0000100000000000]

Fig. 31

CONVERTED PATTERNS

GENRE : ROCK
LEVEL : I

| PART NAME | NUMBER OF BARS | PATTERNS |
|---|---|---|
| INTRO | 4 | (RIM) |
| A | 4 | |
| A' | 4 | |
| B | 8 | |
| C | 8 | |
| B' | 8 | |
| C' | 16 | 1~7 8 |
| ENDING | 2 | |

Fig.32

RHYTHM CREATING SYSTEM FOR CREATING A RHYTHM PATTERN FROM SPECIFYING INPUT DATA

BACKGROUND OF THE INVENTION

1. Field of the Invention

The present invention relates to a rhythm creating system included in an electronic musical instrument to create a rhythm pattern.

2. Description of the Prior Art

Generally, in creating a desired rhythm on an electronic musical instrument, the desired rhythm is created by the user, a rhythm pattern is created by the user, the rhythm pattern is stored in a memory included in the electronic musical instrument and the electronic musical instrument reproduces the rhythm pattern. Alternatively a plurality of rhythms created by the manufacturer are stored in the memory included in the electronic musical instrument, a desired rhythm among those stored in the memory is selected by the user, and the electronic musical instrument reproduces the selected rhythm.

If a predetermined rhythm for one piece of music is desired to be played on the electronic musical instrument, the piece of music is divided into parts including a preliminary part, a theme part, an ending part and the like, and rhythm patterns for those parts are created and stored by the foregoing procedure. That is, according to a first system, which requires the user to create rhythms, rhythm patterns are created for the parts, respectively, by the user, the rhythm patterns for a plurality of bars conforming to the parts are assembled, the assembly of the rhythm patterns are stored in the memory of the electronic musical instrument, a rhythm pattern for the piece of music is constructed by storing the playing sequence of the rhythm patterns for the plurality of bars in the memory, and then the rhythm pattern for the piece of music is played. According to a second system, which enables the user to select a desired rhythm among those stored beforehand in the electronic musical instrument, a plurality of rhythm patterns are stored in the memory of the electronic musical instrument beforehand by the manufacturer, and the user selects a desired rhythm pattern among those stored in the memory, and the selected rhythm pattern is played on the electronic musical instrument.

If a new rhythm pattern is desired, the first system imposes troublesome work requiring much time on the user to create the new rhythm and to store the created rhythm in the memory every time a new rhythm is desired. Furthermore, the composition of a new rhythm pattern requires special knowledge of timing the play of different musical instruments in assembling the rhythm pattern. The second system requires search for a desired rhythm among many rhythm patterns stored beforehand in the memory by the manufacturer. If a greater number of rhythm patterns are stored beforehand in the memory, the probability of a desired rhythm pattern being included in the rhythm patterns stored beforehand may be higher. However, increase in the number of stored rhythm patterns will require more time for finding the desired rhythm pattern. If the number of stored rhythm patterns is reduced, it is possible that a desired rhythm pattern will not be included in the stored rhythm patterns.

A system proposed to solve such problems in Japanese Patent Laid-open (Kokai) No. Sho 61-188594 or Sho 61-18299 or Japanese Patent Publication (Kokoku) No. Hei 3-006515 stores a plurality of rhythm patterns for each musical instrument, selects a rhythm pattern for each musical instrument, and composes an integral rhythm pattern by integrating the selected rhythm patterns respectively for all the musical instruments. This system needs a memory having a storage capacity smaller than that of a memory needed by a system which stores integral rhythm patterns beforehand and has a certain degree of freedom of composing an optional rhythm pattern. However, this system also needs a memory having a large storage capacity to make possible a sufficiently high degree of freedom of composing a desired rhythm pattern. Thus, the number of rhythm patterns to be stored beforehand is limited by the storage capacity of a possible memory.

SUMMARY OF THE INVENTION

In view of the foregoing problems in the prior art, it is a first object of the present invention to provide a rhythm creating system capable of creating a sufficiently large number of rhythm patterns and requiring a memory having a storage capacity smaller than that of a memory needed by the prior art rhythm creating system.

A second object of the present invention is to provide a rhythm creating system capable of creating a rhythm pattern meeting the image of the user without requiring any special knowledge of the user.

A third object of the present invention is to provide a rhythm creating system capable of creating an integral rhythm pattern for a piece of music meeting the image of the user requiring only the designation of the melody of the piece of music and without requiring any special knowledge.

In one aspect of-the present invention, a rhythm creating system comprises:

(a) a primitive data creating means for creating a plurality of primitive data each consisting of code strings of codes "0" and "1";

(b) a parameter storage means for storing a plurality of creating parameters for specifying the meanings of the codes "0" and "1" of the primitive data; and (c) a rhythm pattern creating means for creating a rhythm pattern by associating predetermined creating parameters selected among the plurality of creating parameters with the created primitive data.

Preferably, each of the plurality of creating parameters associates a kind of musical instrument with at least either the code "0" or "1".

Preferably, each of the plurality of creating parameters specifies the meanings of the codes "0" and "1" of the primitive data and specifies the meanings of the code length of the primitive data. In this case, for example, a code length corresponds to a musical length.

A musical length may be associated with a code length by a method which associates a musical length, such as the number of beats, with the entire code length or by an equivalent method which associates a musical length, such as a note length, with each of the codes included in the code length and consequently associates a musical length with the entire code length.

The primitive data creating means may be such a means which is provided with a memory for storing a plurality of primitive data and reads the primitive data from the memory to provide the primitive data.

The primitive data creating means may be provided with a means of creating new primitive data on the basis of the primitive data stored in the memory.

A prior art rhythm creating system storing rhythm patterns stores code strings consisting of the codes "0" and "1" and the code string is associated with a special meaning; for example, the code string corresponds to a pair of high-hat cymbals, each bit corresponds to a 1/16 note, the code "0" corresponds to nonsounding and and the code "1" corresponds to sounding. Accordingly, different code strings must be prepared even if they are the same in bit pattern, if the code strings of the same bit pattern differ from each other even in a single meaning.

In storing code strings (primitive data) consisting of the codes "0" and "1", the present invention does not associate fixed meanings with the codes "0" and "1" of the primitive data in defiance of such a conventional concept. Consequently, a plurality of code strings of the same bit pattern need not be stored respectively for different musical instruments, which enables the reduction of storage capacity.

The present invention stores creating parameters specifying the meanings of the primitive data. The creating parameter associates, for example, the code '0' of 16-bit primitive data selected among a plurality of primitive data with a pair of closed high-hat cymbals, and the code "1" of the same with a pair of open high-hat cymbals. Thus, the different creating parameters assign different musical instruments to the primitive data of the same bit pattern.

The rhythm creating system of the present invention creates primitive data consisting of the codes "0" and "1" which are not associated with fixed meanings, stores a plurality of creating parameters for specifying the meanings of the primitive data, and creates a rhythm pattern by associating the creating parameters with selected primitive data. Accordingly, the rhythm creating system need not be provided with a memory having a very large storage capacity and has a large degree of freedom of creating rhythm patterns.

When no fixed meaning is associated with the code length of the primitive data, and the creating parameter associates meanings to the code length of the primitive data by assigning, for example, four beats to the entire code length of sixteen bits, and 4/4-time to one measure, the same primitive data is used for playing different musical instruments, and each bit corresponds to different notes, such as 1/16 note and $\frac{1}{8}$ note, which enables further reduction in the storage capacity of the memory and further enhances the degree of freedom of rhythm pattern creation.

Since a plurality of primitive data not associated with fixed meanings and a plurality of creating parameters for associating the primitive data with meanings are stored in a memory and a rhythm pattern is created by combining desired primitive data and a desired creating parameter, the storage capacity of the memory of the rhythm creating system need not be very large and the rhythm creating system is capable of creating a large number of rhythm patterns.

A method of selecting the desired primitive data among the plurality of primitive data stored in the memory and a method of selecting a desired creating parameter among the plurality of creating parameters need not be limited to those specified by the present invention; the desired primitive data and the desired creating parameter may directly be selected by the user or the rhythm creating system may be provided with an inference system for forward inference, and appropriate primitive data and an appropriate creating parameter may be selected through forward inference on the basis of parameters specifying a conceptional image of a piece of music, such as "rock 'n' roll rhythm" and "relatively simple rhythm", specified by the user.

A rhythm creating system provided with an inference system in accordance with the present invention comprises:

an input means for providing a plurality of parameters respectively specifying types of rhythm;

a memory storing a rule data base for associating the parameters with rhythm patterns; and a rhythm pattern creating means for creating a desired rhythm pattern by an inference system with reference to the rule data base on the basis of the plurality of parameters provided by the input means.

Preferably, the plurality of parameters provided by the input means include at least those specifying the genre and time of the rhythm to be created Preferably, the inference system of the rhythm pattern creating means is capable of creating different rhythm patterns from the same plurality of parameters provided by the input means and is provided with a means of creating a new rhythm pattern by an arithmetic operation on the basis of the created rhythm pattern. Musical instruments and musical lengths are assigned to the thus created rhythm pattern.

This rhythm creating system is provided with the memory for storing a rule data base conformable to the inference system selected among, for example, a forward inference system, a backward inference system, a fuzzy inference system and a blackboard system. Accordingly, a rhythm pattern meeting an image of rhythm formed by the user can be created without requiring special knowledge of the user only if a parameter conformable to the image formed by the user is specified directly or indirectly by the user. Thus, the rhythm creating system is suitable for use by amateurs or by users of a large variety of classes including amateurs.

If the rhythm creating system is provided with an inference system capable of creating a plurality of different rhythm patterns on the basis of the same parameters specified by the user, the rhythm creating system is able to create a rich variety of rhythm.

The rhythm creating system provided with an inference system in accordance with the present invention stores a rule data base for associating a plurality of parameters consisting of a plurality of choices and specifying types of rhythm with a plurality of rhythm patterns, and creates a rhythm pattern of a desired type with reference to the rule data base on the basis of choices selected among those of each parameter. Accordingly, a memory storing a plurality of rhythm patterns need not be searched for a rhythm pattern conforming to an image of rhythm formed by the user, and the rhythm pattern conforming to the image formed by the user can be created without requiring special knowledge of assembling a rhythm pattern.

The present invention is applicable also to creating a rhythm pattern for an entire piece of music. A rhythm creating system thus constituted in accordance with the present invention will be described with reference to a block diagram shown in FIG. 1. A first rule data base for associating information concerning the melody of an entire piece of music with the component choices of each of a plurality of parameters specifying types of rhythm is stored in a first memory 1. A second rule data base for associating the choices of the plurality of parameters with a plurality of rhythm patterns is stored in a second memory 2. The first memory 1 and the second memory 2 may be either two separate memories or a physically single memory, such as a ROM. The first rule data base and the second rule data base are, for example, of a forward inference system, a backward inference system, a blackboard system or a fuzzy inference system.

An instruction input means 3 is operated to provide information concerning the melody of a desired piece of music. The information provided by the instruction input means 3 is applied to a parameter extracting means 4. The parameter extracting means 4 extracts, for each part of the desired piece of music, the predetermined choices of each of at least some parameters among the plurality of parameters on the basis of the information concerning the melody of the desired piece of music with reference to the first rule data base stored in the first memory 1 and applies the extracted choices to a rhythm pattern creating means 5. The rhythm pattern creating means 5 repeats a rhythm pattern for each part of the desired piece of music on the basis of the choices extracted by the parameter extracting means 4 for each part of the desired piece of music with reference to the second rule data base stored in the second memory 2 to provide a rhythm pattern for the entire desired piece of music.

The parameter extracting means 4 and the rhythm pattern creating means may be either pieces of hardware or functions of software to be executed by a computer.

Preferably, the instruction input means 3 is capable of providing data representing the genre of the desired piece of music in addition to the information concerning the melody of the entire desired piece of music.

In this rhythm creating system, the parameter extracting means 4 extracts, for each part of the desired piece of music, the predetermined choices of at least some parameters among the plurality of parameters specifying predetermined types of rhythm on the basis of the information concerning the melody of the entire desired piece of music and the rhythm pattern creating means 5 creates a rhythm pattern for each part of the desired piece of music on the basis of the choices extracted by the parameter extracting means 4 for each part to provide the rhythm pattern for the entire desired piece of music. Accordingly, the user needs to operate the instruction input means 3 to provide only the information concerning the melody of the desired piece of music and need not have any special knowledge of assembling a rhythm pattern, and then the rhythm creating system creates a rhythm pattern for one piece of music, meeting an image formed by the user. If a method capable of specifying information representing an abstract human idea is employed in providing the information concerning the melody of an entire piece of music, the rhythm creating system will be readily accessible to the user who is weak in mechanically assembling a rhythm pattern.

Although the rhythm creating system for creating a rhythm pattern for the entire piece of music may be such as capable of creating rhythm patterns suitable for pieces of music of a specific genre among those including, for example, rock 'n' roll music, waltz music and swing music, the rhythm creating system may be capable of creating rhythm patterns suitable for pieces of music of a plurality of genres and the genre of a desired piece of music may be provided by the instruction input means 1 in addition to the information concerning the melody of the entire desired piece of music. If the instruction input means 1 is capable of providing the complex details of the rhythm of a desired piece of music, the rhythm creating system is able to create a great variety of rhythm patterns.

The rhythm creating system thus constituted in accordance with the present invention to create a rhythm pattern for an entire piece of music extracts, for each part of the piece of music, the predetermined choices of at least some of the plurality of parameters specifying types of rhythm on the basis of the information concerning the melody of the entire piece of music, and creates a rhythm pattern for each part on the basis of the extracted predetermined choices for each part to create a rhythm pattern for the entire piece of music. Accordingly, the user needs to provide only the information concerning the melody of the entire piece of music, the user need not have any special knowledge of assembling a rhythm pattern for the entire piece of music, and the rhythm creating system is capable of creating a rhythm pattern for the piece of music, meeting an image formed by the user. If a method capable of specifying information representing an abstract human idea is employed in providing the information concerning the melody of an entire piece of music, the rhythm creating system will be readily accessible to the user who is weak in mechanically assembling a rhythm pattern.

If the instruction input means is capable of providing the genre of a desired piece of music in addition to the information concerning the melody of the desired piece of music, the rhythm creating system is able to create rhythm patterns for pieces of music of a plurality of genres including rock 'n' roll music, waltz music and swing music. If the instruction input means is capable of providing the complex details of the rhythm of a desired piece of music, the rhythm creating system is able to create a great variety of rhythm pattern.

BRIEF DESCRIPTION OF THE DRAWINGS

FIG. 4 is a table of rule number, creating parameter number and primitive data number;

FIG. 5 is table showing the contents of creating parameters;

FIG. 6 is a table showing the contents of the primitive data;

FIG. 11 is a view of input parameters to be provided by a control element; FIG. 12 is a view showing facts before inference and those after inference, stored in an inference work area, respectively;

FIG. 13 is a view of the contents of a rule data base;

FIG. 14 is a view of pattern creation command included in facts determined by inference;

FIG. 15 is a view of a bit rhythm pattern created on the basis of a pattern creation command;

FIG. 17 is a view showing the contents of an inference work area before and after inference, in which input parameters "LEVEL" and "IDEA" shown in FIG. 11 are "6" and "7";

FIG. 18 is a view showing a bit rhythm pattern created through inference shown in FIG. 17;

FIG. 20 is a view showing the contents of an inference work area before and after inference when inference is made three times without changing the values of the input parameters shown in FIG. 11;

FIG. 21 is a view showing a bit rhythm pattern created by inference of FIG. 20;

FIG. 26 is tables of parameters provided by a parameter input unit;

FIG. 27 is a view showing a song creating rule included in a rule data base for a song creating unit;

FIG. 28 is a view showing the result of inference performed by the song creating unit;

FIG. 29 is a view showing a pattern creating rule included in a rule data base for a pattern creating unit;

FIG. 30 is a view showing the result of inference performed by the pattern creating unit;

FIG. 31 is a view of assistance in explaining bit rhythm pattern creation; and FIG. 32 is a diagram of a final rhythm pattern expressed by musical notes.

DESCRIPTION OF THE PREFERRED EMBODIMENTS

Preferred embodiments of the present invention will be described hereinafter with reference to the accompanying drawings.

Figure 1:
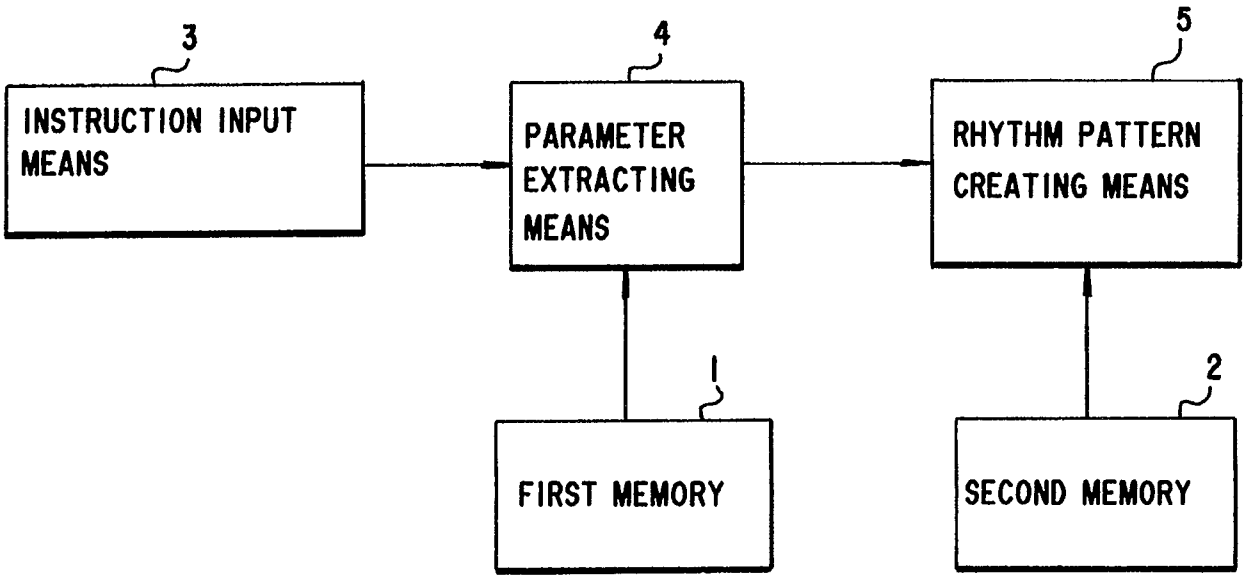
FIG. 1 is a block diagram of assistance in explaining the configuration of the present invention for creating a rhythm pattern for an entire piece of music.
Figure 2:
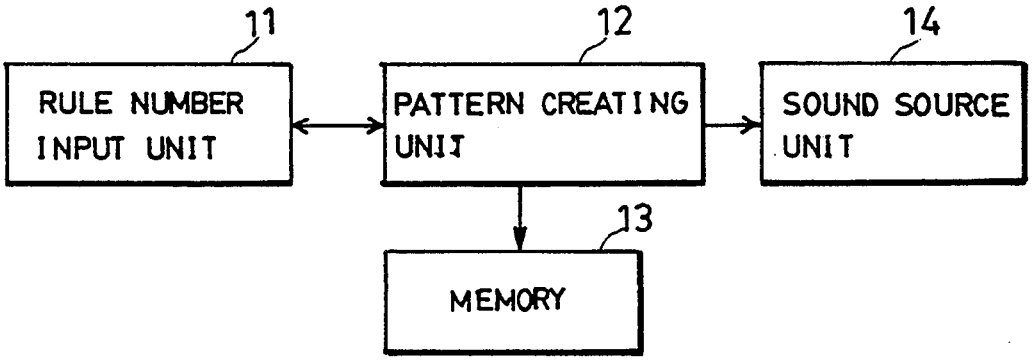
FIG. 2 is a block diagram of a rhythm creating system in a preferred embodiment according to the present invention.

FIG. 2 is a block diagram showing the general configuration of a rhythm creating system in a preferred embodiment according to the present invention.

Referring to FIG. 2, a rule number input unit 11 has a display, not shown, and a keyboard, not shown, provided with numerical keys. A plurality of rule numbers indicating creating parameters and corresponding primitive data, stored in a memory 13 are read by a pattern creating unit 12 and displayed on the display of the rule number input unit 11. The keyboard of the rule number input unit 11 is operated to enter a desired rule number. Then, the pattern creating unit 12 makes reference to the the memory 13 and reads a creating parameter and primitive data specified by the rule number from the memory 13. Then, the pattern creating unit 12 creates rhythm patterns by combining the creating parameter and the primitive data and gives the created rhythm patterns to a sound source unit 14. Then, the sound source unit 14 creates sound source waveforms corresponding to the rhythm patterns, signals representing the sound source waveforms are amplified by an amplifier and rhythm represented by the signals is sounded by a loudspeaker.

Figure 3:
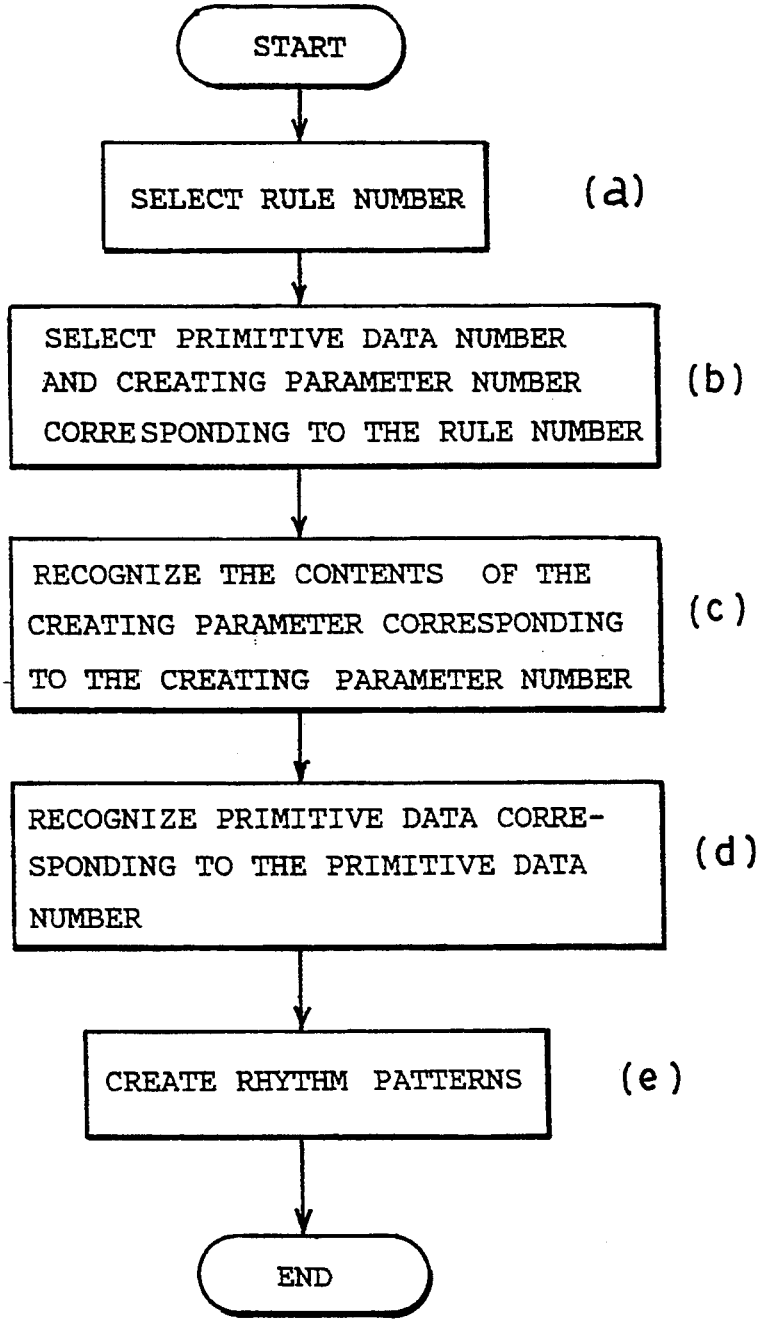
FIG. 3 is a flow chart of a rhythm creating process to be carried out by the rhythm creating system of FIG. 1.

FIG. 3 is a flow chart of a rhythm creating procedure to be carried out by the rhythm creating system of FIG. 2, FIG. 4 is a table showing the relation between rule number, creating parameter number and primitive data number, FIG. 5 is a table showing the contents of creating parameters indicated by creating parameter numbers and FIG. 6 is a table showing the contents of primitive data indicated by primitive data number and stored in the memory 13 of FIG. 2.

Referring to FIG. 4, each rule number corresponds to a creating parameter number, a primitive data number and a timbre, such as DRY, POWER or REVERB.

Referring to FIG. 3, a desired rule number among those shown on the display is selected and entered by operating a rule number input unit 11 in step (a). It is possible that the user is perplexed in selecting a rule number when only creating parameter numbers and primitive data numbers are displayed on the display as shown in FIG. 4. Therefore, sensory expressions expressing creating parameters indicated by creating parameter numbers, primitive data indicated by primitive data numbers or combinations of creating parameter numbers and primitive data numbers, such as "1. Relatively simple rock 'n' roll rhythm" and "relatively complex waltz rhythm" may be displayed instead of the table shown in FIG. 4 on the display to facilitate the selection of a rule number.

Suppose that rule number "1" is selected. Then, in step (b), the pattern creating unit 12 fetches timbre DRY, indicated by rule number "1".

In step (c), the pattern creating unit 12 recognizes the contents of the creating parameter indicated by the creating parameter number "1" and contained in the table shown in FIG. 4 stored in the memory 13, and then, in step (d), the pattern creating unit 12 recognizes primitive data contained in the table shown in FIG. 6 stored in the memory 13.

As shown in FIG. 5, the contents of the creating parameter No. 1 are:

(a) "1"=closed high-hat cymbals, (b) code "0"=nonsounding, (c) musical length=two beats, and (d) four beats for one bar (4/4 time)

Therefore, the contents (a) to (d) are applied to the primitive data "0001" to create a rhythm pattern having bits each corresponding to a 1/8 note and bars each of "00010001" which is for a pair of closed high-hat cymbals. Since the rule No. 1 specifies "DRY" timbre (FIG. 4), the sound source 4 creates musical signals corresponding to the rhythm pattern "001001" which is a sound of the pair of closed high-hat cymbals having "DRY" timbre.

Although the codes "1" and "0" of the primitive data correspond simply to specific musical sounds (including no sound generation) in the foregoing description, the following variation is also possible.

For example, if primitive data "0101" and a creating parameter specifying:

(a) code "1"=a pair of open high-hat cymbals, (b) code "0"=the former musical instrument, and
(c) two beats for the musical length of the primitive data are selected,
(a pattern for a pair of closed high-hat cymbals)−(-primitive data) and
(a pattern for a pair of open high-hat cymbals)+(-primitive data)

are calculated to change the pair of closed high-hat cymbal bits coinciding with the primitive data for a pair of open high-hat cymbals.

Concretely, $$(10111011) \text{ and } \overline{(01010101)}=(10101010)$$

$$(01000100) \text{ or } (01010101)=(10101010)$$

are calculated to change the rhythm pattern for the pair of closed high-hat cymbals from "10111011" to "10101010" and the rhythm pattern for the pair of open high-hat cymbals from "01000100" to "01010101".

Thus, a great variety of rhythm patterns can be created and rhythm patterns thus created can be modified by combining primitive data and creating parameters.

Although a rule number directly connected with a creating parameter number and a primitive data number is specified by the user in the foregoing description, the rhythm creating system may be constructed, for example, so as to receive imaginary information, such as information expressing rock 'n' roll rhythm of a complex pattern, to select a creating parameter on the basis of the input information by inference, to create a primitive data and to create a rhythm pattern on the basis of those selected and to create a rhythm pattern and primitive data regardless of means for selecting and creating a creating parameter and a primitive data.

A rhythm creating system provided with an inference system in accordance with the present invention will be described hereinafter.

Figure 7:
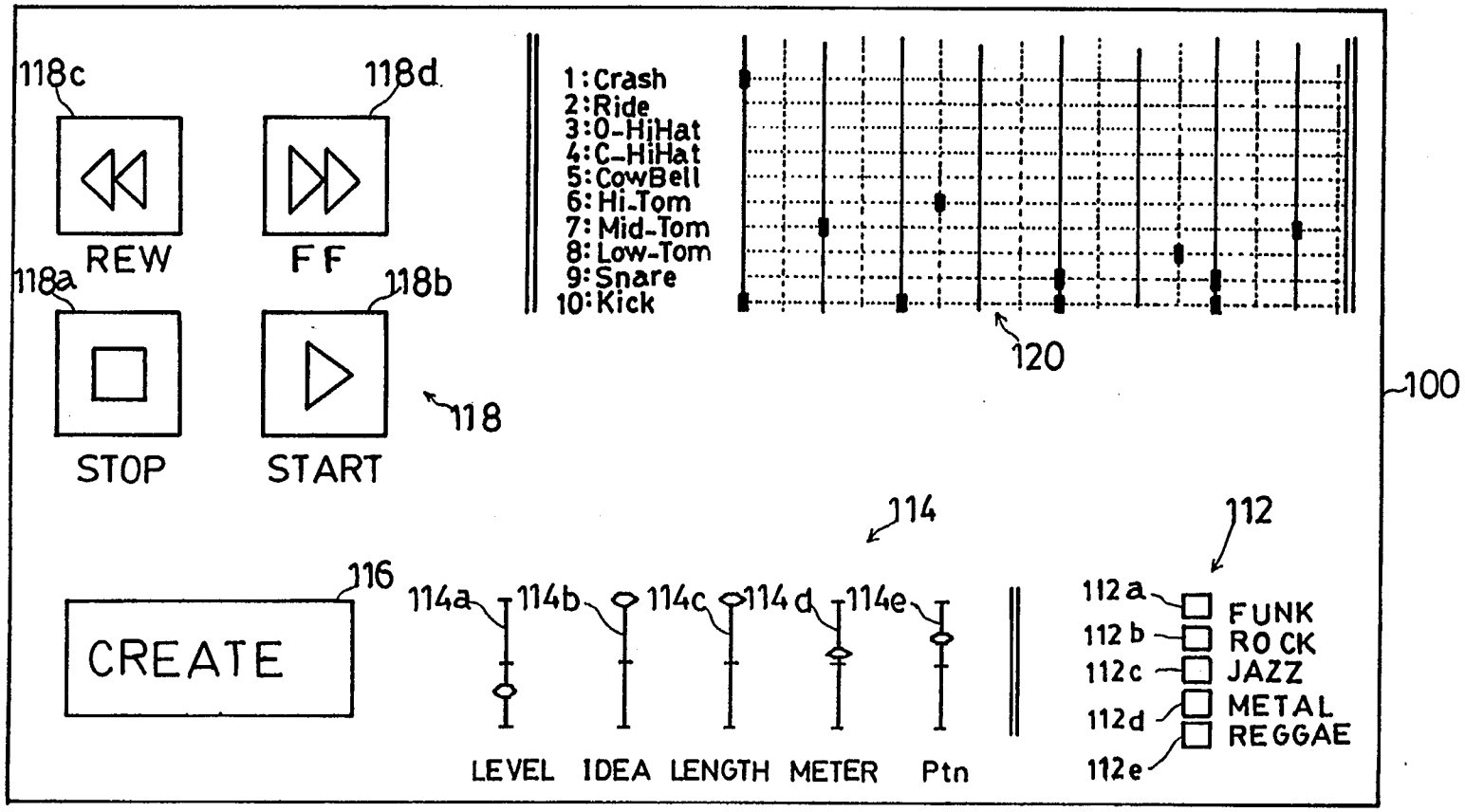
FIG. 7 is a plan view of the control panel of the rhythm creating system of FIG. 2.

FIG. 7 shows a rhythm creating system provided with an inference system in accordance with the present invention.

Referring to FIG. 7, genre select keys 112 for selecting funky rhythm (FUNK), rock 'n' roll rhythm (ROCK), jazz rhythm (JAZZ), metal rhythm (METAL) and reggae rhythm (REGGAE) are arranged in the right-hand lower corner of the control panel 100 of the rhythm creating system. The rhythm creating system creates a rhythm pattern when a create key 116 is pushed after pushing one of the genre select keys 112 and shifting parameter input volume keys 114 for setting parameters specifying level (LEVEL), idea (IDEA), length (LENGTH), meter (METER) and pattern (Ptn) to positions conforming to an image formed by the user, respectively.

Images corresponding to the respective parameters of level (LEVEL), idea (IDEA), length (LENGTH), meter (METER) and pattern (Ptn) will be described hereinafter.

(a) Parameter "LEVEL" specifies the level of complexity of a created rhythm pattern. The parameter input volume key 114*a* is shifted upward to raise the level of complexity of the rhythm pattern.
(b) Parameter "IDEA" specifies the instrumentation of musical instruments to-be used. The parameter input volume key 114*b* is shifted upward to increase the kinds of musical instruments to be used and, if the key 114*b* is shifted to a far upper position, musical instruments which are not used very often are used. For example, although it is usual to use only a drum set when the genre "ROCK" is selected, a sound synthesizer, a Latin percussion instrument and/or an ethnic percussion instrument is used if the key is shifted to a far upper position.
(c) The parameter "LENGTH" specifies the number of bars of a rhythm pattern to be created. The parameter input volume key 114*c* is shifted upward to increase the number of bars of the rhythm pattern.
(d) The parameter "METER" specifies the number of beats of one bar of a rhythm pattern to be created. The parameter input volume key 114*d* is shifted upward to increase the number of beats of the rhythm pattern.
(e) The parameter "Ptn" specifies the type of a rhythm pattern to be created. The parameter input volume key 114*e* is positioned selectively to select an introductory type (INTRO), a basic type (BASIC), a fill-in type (FILLIN) and an ending type (ENDING).

When one of the genre select keys 112 is pushed, the parameter input volume keys 114 are set respectively at positions corresponding to an image formed by the user and then the create key 116 is pushed, the rhythm creating system creates a rhythm pattern conforming to the image. A procedure of creating the rhythm pattern will concretely be described later.

Pattern reproducing keys 118, i.e., a stop key 118*a*, a start key 118*b*, a preceding data key 118c and a succeeding data key 118*d*, are arranged in the left-hand upper corner of the upper panel 100 of the rhythm creating system. The start key 18*b* is pushed to start playing the rhythm created by the rhythm creating system, and the stop key 18*a* is pushed to stop playing the rhythm. When the data return key 18*c* is pushed once the data of, for example, the preceding bar is reproduced. The preceding data key 18*c* corresponds to the rewind key of a tape recorder for recording information in a magnetic tape contained in a tape cassette. When the succeeding data key 18*d* is pushed once, the data of the succeeding bar is reproduced. The succeeding data key 18*d* corresponds to the fast feed key of the tape recorder.

A liquid crystal display screen 120 is placed in the right-hand upper corner of the upper panel 110 to display successive portions of the rhythm pattern each for one bar successively thereon while the rhythm is being played.

Figure 8:
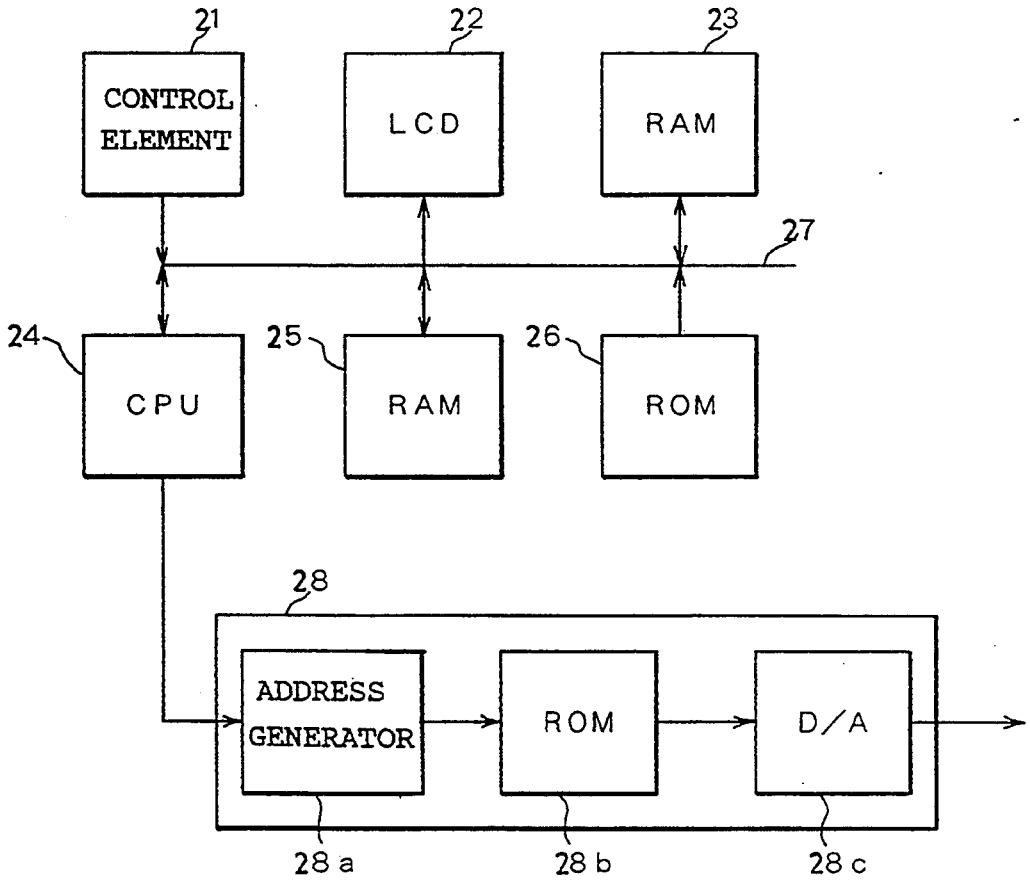
FIG. 8 is a block diagram of the circuit configuration of the rhythm creating system shown in FIG. 1.
Figure 9:
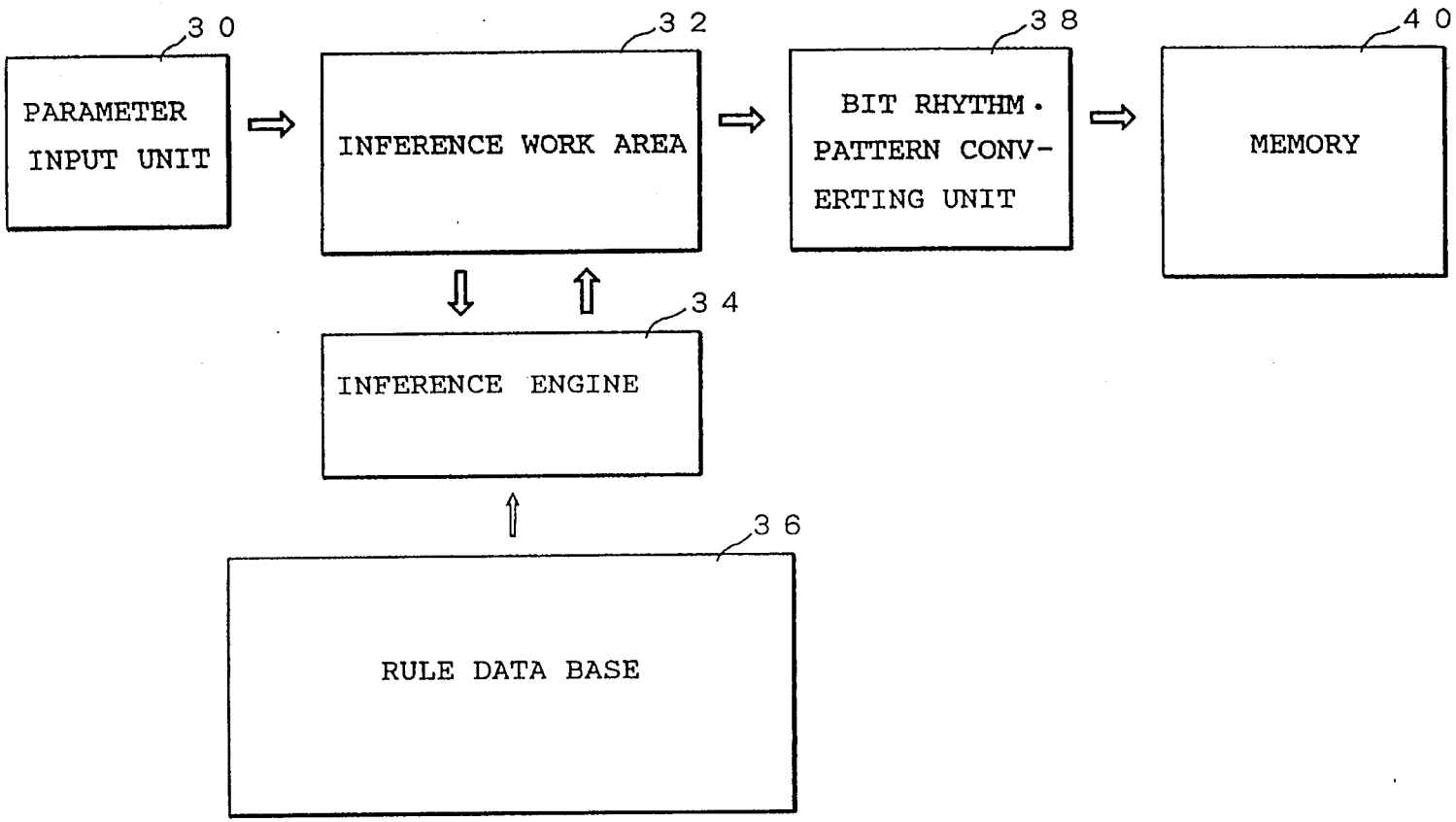
FIG. 9 is a block diagram of assistance in explaining the relation between rhythm creating functions.

FIG. 8 is a block diagram of the circuit configuration of the rhythm creating system having the upper panel shown in FIG. 7, and FIG. 9 is a block diagram of assistance in explaining the relation between rhythm creating functions.

Referring to FIG. 8, a control element 21 comprises the genre select keys 112, the parameter input volume keys 114, the create key 116 and the pattern reproducing keys 118 shown in FIG. 7. When the parameter input volume keys 114 of the control element 21 are operated, parameters corresponding to the positions of the parameter input volume keys 114 are converted into digital data by AD conversion and a CPU 24 receives the digital data and stores the same in a RAM 23. The control element 21 corresponds to a parameter input unit 30 shown in FIG. 9. Category data provided by operating the genre select key 112 and stored in the RAM 23 and the parameters provided by operating the parameter input volume keys 114*a* to 114*d* are converted into character strings and the character strings are stored as "facts" in an inference work area 32 (FIG. 9) of a RAM 25. A liquid crystal display driving circuit LCD 22 is controlled by the CPU 24 to drive the liquid crystal display 120 (FIG. 7) so that desired information is displayed on the liquid crystal display 120. Programs to be executed by the CPU 26 and a rule data base 36 for inference are stored in a ROM 26. A program among those stored in the ROM 26, concerning inference corresponds to an inference engine 34 shown in FIG. 9 and this program is executed after the detection of the facts by an inference system. A program for creating a rhythm pattern on the-basis of the facts corresponds to a bit rhythm pattern conversion unit 38 shown in FIG. 9. A rhythm pattern created by the bit rhythm pattern conversion unit 38 is stored in a memory 40 (FIG. 9) of the RAM 23

After the rhythm pattern thus created has been stored in the RAM 23, the start key **118*b* (FIG. 7) is pushed. Then, the CPU 24 reads the rhythm pattern stored in the RAM 23 and sends the data of the rhythm pattern sequentially to a sound source unit 28. The sound source unit 28 has a ROM 28*b* storing data representing digital waveforms of rhythmical sounds of rhythm musical instruments including a bass drum, a snare drum, open high-hat cymbals and closed high-hat cymbals, and an address generator 28*a* which addresses the contents of the ROM 28*b*. The data of the rhythm pattern sequentially provided by the CPU 24 is converted into address signals specifying addresses of the ROM 28*b* by the address generator 28*a* and the digital waveforms of the musical sounds are read from the ROM 28*b* according to the address signals. The digital waveforms are converted into analog waveforms of the musical sounds by a DA converter 28*c***, noise is removed from the analog waveforms by a lowpass filter, not shown, and then the rhythm creating system provides the analog waveforms. The analog waveforms provided by the rhythm creating system are amplified by an amplifier, not shown, and rhythmical sounds represented by the analog waveforms are sounded.

Figure 10:
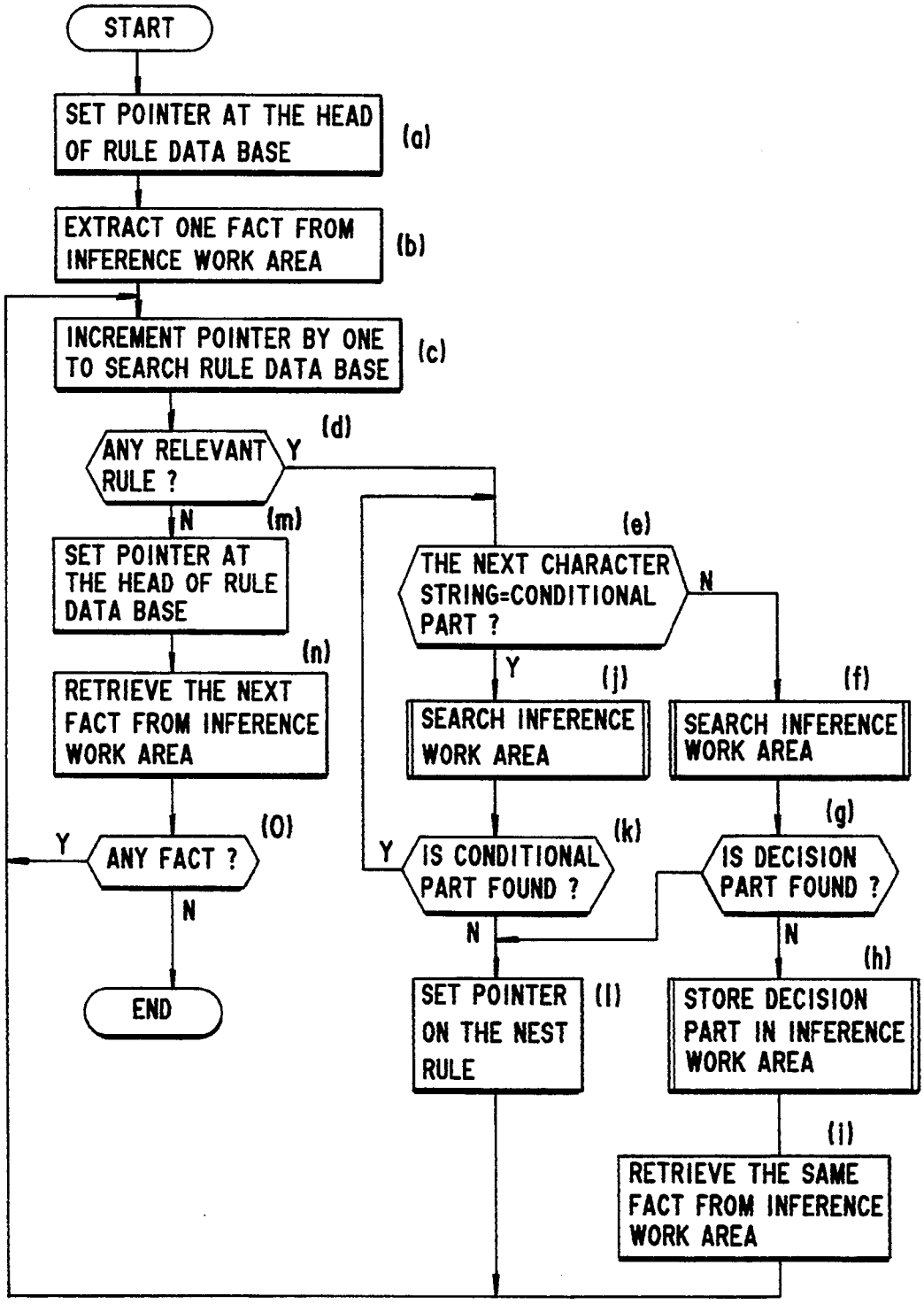
FIG. 10 is a flow chart of an algorithm of an inference engine.

FIG. 10 is a flow chart of an algorithm of the inference engine 34, FIG. 11 shows, by way of example, input parameters, which are represented by characters to facilitate understanding, provided by operating the control element 51, FIG. 15 shows, by way of example, facts before inference and those after inference, stored in the inference work area 32, and FIG. 13 shows, by way of example, the contents of the rule data base 36.

After operating the control element 21 to provide, for example, parameters as shown in FIG. 11, i.e., a genre parameter GENRE specifying rock 'n' roll rhythm ROCK, a pattern parameter Ptn specifying a basic pattern BASIC, a length parameter LENGTH specifying 4 bars, a level parameter LEVEL specifying a level 2, an idea parameter IDEA specifying an instrumentation class 2 and a meter parameter METER specifying 4/4 time and temporarily storing the parameters in the RAM 23, the parameters are stored as facts in the inference work area 32 as shown in the left portion of FIG. 12.

The parameters before inference include additionally a variation parameter VARI. The variation parameter VARI is produced when the create key 116 is operated without changing the parameters shown in FIG. 11. The variation parameter VARI, which cannot be specified by the user, introduces variations into the pattern. If the create key 116 is operated again without-changing the parameters, the values of the variation parameter VARI changes to produce a different pattern automatically. Random numbers created by operating the create key 116 may be assigned to the variation parameter VARI. The value of the variation parameter VARI returns to "1" every time the parameters as shown in FIG. 11 are changed.

A program as shown in Fig- 10 corresponding to the inference engine 34 is started when the create key 116 is operated in this state. A pattern creating procedure will be described hereinafter on an assumption that the parameters shown in FIG. 11 are provided.

When the program shown in FIG. 10 is started in a state where the parameters as shown in FIG. 12 are set, a pointer is set at the head of the rule data base in step (a) to retrieve data from the rule data base. One of the facts, the first fact "ROCK", is retrieved from the inference work area in step (b). The pointer is incremented in step (c) one at a time to search the rule data base for a rule having a character string "ROCK". A query is made in step (d) to see if any rule having a character string "ROCK" is found. Since a rule *1 has the character string "ROCK", the pointer of the rule data base is incremented by one and a query is made in step (e) to see if a character string next to the character string "ROCK" is a conditional part (e.g., if character string "ROCK" is followed by "and"). Since the character string next to the character string "ROCK" is a decision part "ALWAYSO" in this example, the program goes to step (f). In step (f), the inference work area is searched for the decision part "ALWAYSO". Since the decision part "ALWAYSO" is not stored in the inference work area in this embodiment, the response in step (g) is negative and step (h) is executed to store the decision part "ALWAYSO" in the inference work area.

In step (i), the same fact as the fact retrieved in the previous fact retrieval cycle, i.e., the fact "ROCK", is retrieved, and then the program returns to step (c). In step (c), the pointer of the rule data base is incremented further and the rule data base is searched for the fact "ROCK".

Since no fact "ROCK" is found in the rule data base in the second or following fact retrieval cycles, the response in step (d) is negative and step (m) is executed. In step (m), the pointer is returned to the head of the rule data base and, in step (n), the next fact, i.e., a fact "BASIC", is retrieved from the inference work area. Since further facts are stored in the inference work area, the response in step (o) is affirmative, and hence the program returns to step (c) to retrieve the fact "BASIC".

The fact "BASIC" is included in a rule *2 and hence the response in step (d) is affirmative. Therefore, the pointer of the rule data base is incremented further by one, reference is made to a character string "ALWAYSO" next to the character string "BASIC", and then a query is made in step (e) to see if the character string "ALWAYSO" is followed by "and", i.e., if the character string "ALWAYSO" is a conditional part. If the response in step (e) is affirmative, step (j) is executed. In step (j), the inference work area is searched for the character string "ALWAYSO". A query is made in step (k) to see if the character string "ALWAYSO" is found in the inference work area. If the response in step (k) is affirmative, the program returns to step (e), in which the pointer of the rule data base is incremented and a query is made to see if a character string "ROCKO" next to the character string "ALWAYSO" is a conditional part. Since the character string "ROCKO" is a decision part followed by "then", step (f) is executed to search the inference work area for the character string "ROCKO". Since the character string "ROCKO" is not stored in the inference work area, the response in step (g) is negative, the decision part is stored in the inference work area in step (h), the same fact as that retrieved in the previous fact retrieval cycle from the inference work area in step (i), and then the program returns to step (c). The fact "ROCKO" found in this fact retrieval cycle is a parameter specifying an area to be searched in the rule data base; that is, the fact "ROCKO" limits the area to be searched in the rule data base to the head of the rule data base and to an area between labels "ROCKO" and "ROCKEND". The same steps are repeated until the last fact "7th:ADD=OHIHAT:TYPE=8:ID=01" is retrieved. If no more facts are found in the inference work area, i.e., the response in step (o) is negative, search of the rule data base is ended. The facts retrieved and stored in the inference work area are given to the bit rhythm pattern converting unit 38 (FIG. 9); that is, the facts are looked-up by a program to be executed by the bit rhythm pattern converting unit 38.

Figure 16:
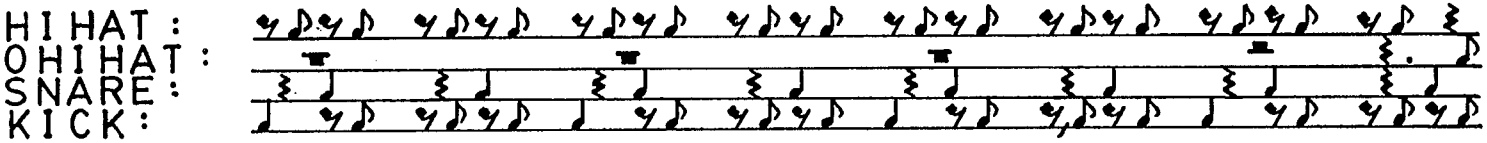
FIG. 16 is a diagram of a bit rhythm pattern.

FIG. 14 shows pattern creation instructions extracted from the facts after inference (FIG. 12), FIG. 15 shows bit rhythm patterns created according to the pattern creation instructions and FIG. 16 shows final rhythm patterns. The operation of the bit rhythm converting unit 38 will be described hereinafter with reference to FIGS. 14 to 16.

The bit rhythm pattern converting unit 38 extracts facts forming pattern creation instructions and those forming pattern edit instructions from the facts after inference. Since only the facts forming pattern creation instructions are determined by inference in this example, no pattern edit instruction is extracted (FIG. 14). The extracted pattern creation instructions are developed in bit strings to form bit rhythm patterns (FIG. 15).

Shown hereunder are commands for pattern creation instructions and pattern edit instructions.

LOAD
- Format:
  - LOAD=(Sound source name):(Resolution:(Primitive data)
- Function:
  - (Primitive data) is copied on (Sound source name)
  - Bit patterns of (Sound source name) before LOAD are cleared.

ADD
- Format:
  - ADD=(Sound source name:(Resolution):(Primitive data)
- Function:
  - (Primitive data) is added to (The bit pattern of sound source name).
  - Bit pattern of (sound source name) before ADD is retained.

DEL
- Format:
  - DEL=(Sound source name):(Resolution):(Primitive data)
- Function:
  - (Primitive data) is deleted from (Bit pattern of the sound source name)

CHG
- Format:
  - CHG=(Sound source name 1):(Genre):(Sound source name 2)
- Function:
  - Primitive data assigned to (Sound source name 1) is changed for primitive data assigned to (sound source name 2) of (Genre)

SWAP
- Format:
  - SWAP=(Sound source name 1)*(Sound source name 2):(Resolution):(Primitive data)
- Function:
  - ((Primitive data) is copied on (Sound source name 2), and AND following (Sound source name 1) is removed, and OR between the result of removal of AND and (Bit pattern of sound source name 2) is removed. (Primitive data) is subtracted from (Bit pattern of sound source name 1).
  - This command is used for replacing an event having closed high-hat cymbals with open high-hat cymbals.
  - (Bit pattern of sound source name 1)−(Primitive data)
  - (Bit pattern of sound source name 2)+(Primitive data)

In this example, "sound source name" is a register corresponding to a musical instrument to be sounded, "resolution" is data representing the code length of one bit of primitive data, which is a code string consisting of codes "0" and "1". "Add bit pattern (data) B to bit pattern (data) A" means an operation "A OR B" for each bit. "Subtract bit pattern (data) B from bit pattern (data) A" means an operation "A AND B" for each bit to be executed when the logic of each bit of bit pattern (data) B is inverted to provide a bit pattern B'.

The pattern creation instructions and pattern edit instructions shown in FIG. 14 are executed according to those commands to develop the bit pattern data in bit patterns as shown in FIG. 15.

For example, the pattern creation instruction: "LOAD=HIHAT:TYPE=8:ID=FF" shown in FIG. 14 is developed in the following bit pattern according to the commands.

"LOAD=HIHAT" means writing primitive data FF (hexadecimal notation), i.e., "1111 1111" in binary notation, corresponding to a code length of ⅛ note in a register HIHAT. Since 4/4 time is specified as a fact in FIG. 12, the data of a bit rhythm pattern for one bar actually written in the register HIHAT is "1111 1111 1111 1111 1111 1111 1111 1111". Similarly, the pattern creation instruction: "DEL=HIHAT:TYPE=8:ID=AA" is developed in a bit rhythm pattern: "1010 10101 1010 1010 1010 1010 1010 1010". This bit rhythm pattern is subtracted from the bit pattern stored in the register HIPlAT. When the pattern creation instruction: "7TH:DEL=HIHAT:TYPE=8:ID=01" is developed, primitive data "0000 0001" corresponding to a code length of ⅛ note is subtracted from the seventh data among eight data obtained by dividing all the data stored in the register HIHAT into equal eight portions, and the pattern creation instruction "7TH:ADD=OHIHAT:TYPE=8:ID=01" is added to the primitive data "0000 0001". Consequently, a bit rhythm pattern "0101 0101 0101 0101 0101 0101 0100" is formed for closed high-hat cymbals corresponding to the register HIHAT. Bit rhythm patterns for other sound sources are formed; For example, a bit rhythm pattern "0010 0010 0010 0010 0010 0010 0010 0010" is formed for a snare drum for rock 'n' roll rhythm, and a bit rhythm pattern "1001 0101 1001 0101 1001 0101 1001 0101" is formed for a bass drum for rock 'n' roll rhythm. Finally, bit rhythm patterns as shown in FIG. 15 are thus created, which are represented by musical notes as shown in FIG. 16.

A bit rhythm pattern creating operation when some of the parameters are changed will be described hereinafter.

FIG. 17 shows parameters stored in the inference work area before and after inference, in which the values of the parameters LEVEL and IDEA are different from the those of the same parameters shown in FIG. 11. In FIG. 17, the value of the parameter LEVEL is "7" and that of the parameter IDEA is "6". FIG. 18 shows bit rhythm patterns formed by inference shown in FIG. 17, and FIG. 19 shows bit rhythm patterns represented by musical notes.

Figure 19:
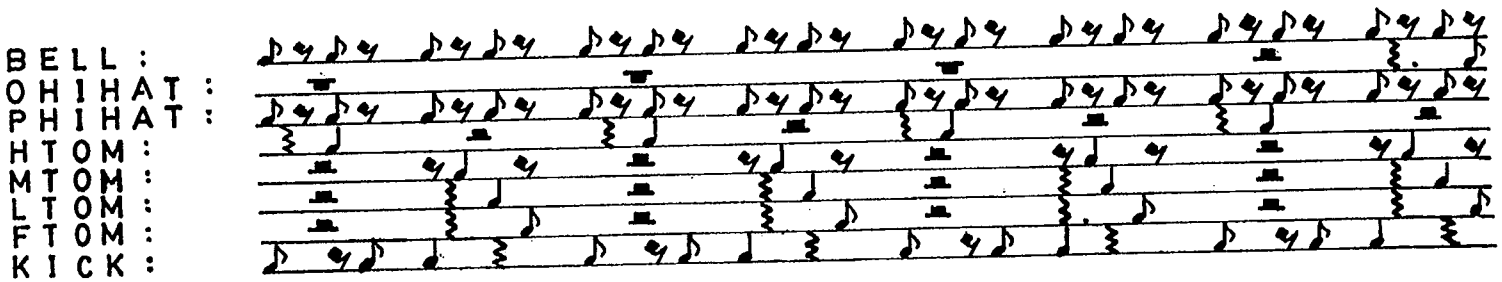
FIG. 19 is a diagram showing the bit rhythm pattern of FIG. 18 expressed by musical notes.

Referring to FIG. 17 to 19, the contents of the register HIHAT are replaced with those of a register BELL in accordance with a pattern edit instruction SWAP. In an example shown in FIG. 18, data "1111 1111 1111 1111 1111 1111 1111 1111" is written in the register HIHAT, and then data "1010 0101 0101 0101 0101 0101 0101 0101" is subtracted from the contents of the register HIHAT. Then, logical AND and logical OR between the contents of the register HIHAT and data "1010 1010 1010 1010 1010 1010 1010 1010" are carried out in accordance with the pattern edit instruction SWAP to create a bit rhythm pattern "1010 1010 1010 1010 1010 1010 1010 1010" for the register BELL.

Data "0010 0010 0010 0010 0010 0010 0010 0010" is written in a register SNARE, and then data "0000 0100 0000 0100 0000 0100 0000 0100" is added to the contents of the register SNARE. Consequently, data "0010 0110 0010 0110 0010 0110 0010 0110" is written in the register SNARE. Then, logical AND and logical OR are carried out between the contents of the register SNARE and data "0010 0000 0010 0000 0010 0000 0010 0000" in accordance with the pattern edit instruction SWAP to create a bit rhythm pattern "0010 0000 0010 0000 0010 0000 0010 0000" for a register HTOM.

Similarly, bit rhythm patterns are created for other resisters MTOM and LTOM.

A bit rhythm pattern creating operation when inference is repeated without changing the parameters will be described hereinafter.

Figure 22:
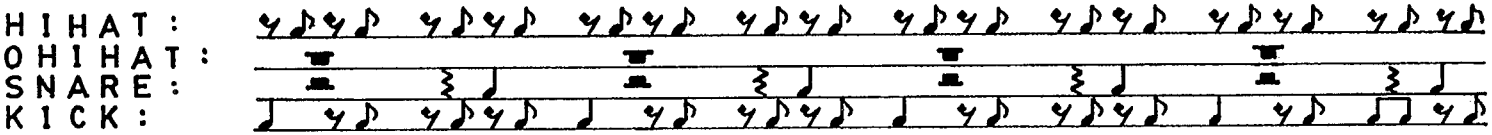
FIG. 22 is a diagram of the bit rhythm pattern of FIG. 21 expressed by musical notes.

FIG. 20 show the condition of the inference work area before and after inference, respectively, when inference is performed three times without changing the input parameters shown in FIG. 11, FIG. 21 shows bit rhythm patterns obtained through inference shown in FIG. 20, and FIG. 22 shows the bit rhythm patterns of FIG. 21 represented by musical notes.

Referring to FIGS. 20 to 22, the contents of the register SNARE are changed in accordance with the pattern creation instruction "LOAD=SNARE:TYPE=8-:ID=22". In the example shown in FIG. 15, data "0010 0010 0010 0010 0010 0010 0010 0010" is written in the register SNARE and, consequently, a bit rhythm pattern "0000 0010 0000 0010 0000 0010 0000 0010" is created.

Data "1001 0101 1001 0101 1001 0101 1001 0101" is written in a register KICK, a bit rhythm pattern "10100010", in which the musical length of one bit corresponds to a 1/16 note, in the register KICK in accordance with a pattern creation instruction "8TH:LOAD=KICK:TYPE=16:ID=A2", and then data "0000 0010 0000 0010 0000 0010 0000 0010" is written in the register KICK in accordance with a bit rhythm pattern creation instruction "LOAD=-SNARE:TYPE=8:ID=02" to create a bit rhythm pattern "0000 0010 0000 0010 0000 0010 0000 0010".

Data "1001 0101 1001 0101 1001 0101 1001 0101" is written in the register KICK, and then a bit rhythm pattern "10100010", in which the musical length of one bit corresponds to a 1/16 note, is written in the register KICK in accordance with a pattern creation instruction "8TH:LOAD=KICK:TYPE=16:ID=A2". Consequently, a bit rhythm pattern "1001 0101 1001 0101 1001 0101 1001 0101" is created.

The bit rhythm patterns thus created are stored in the memory 40 of the RAM 25. When the start key **118*b* is pushed, the bit rhythm patterns are read from the memory 40 and applied to the sounding unit 28, the sound source unit 28** creates musical sounds of the bit rhythm patterns, and then the musical sounds are sounded by the loudspeaker, not shown.

A rhythm creating system capable of creating a rhythm pattern for an entire piece of music will be described hereinafter.

Figure 23:
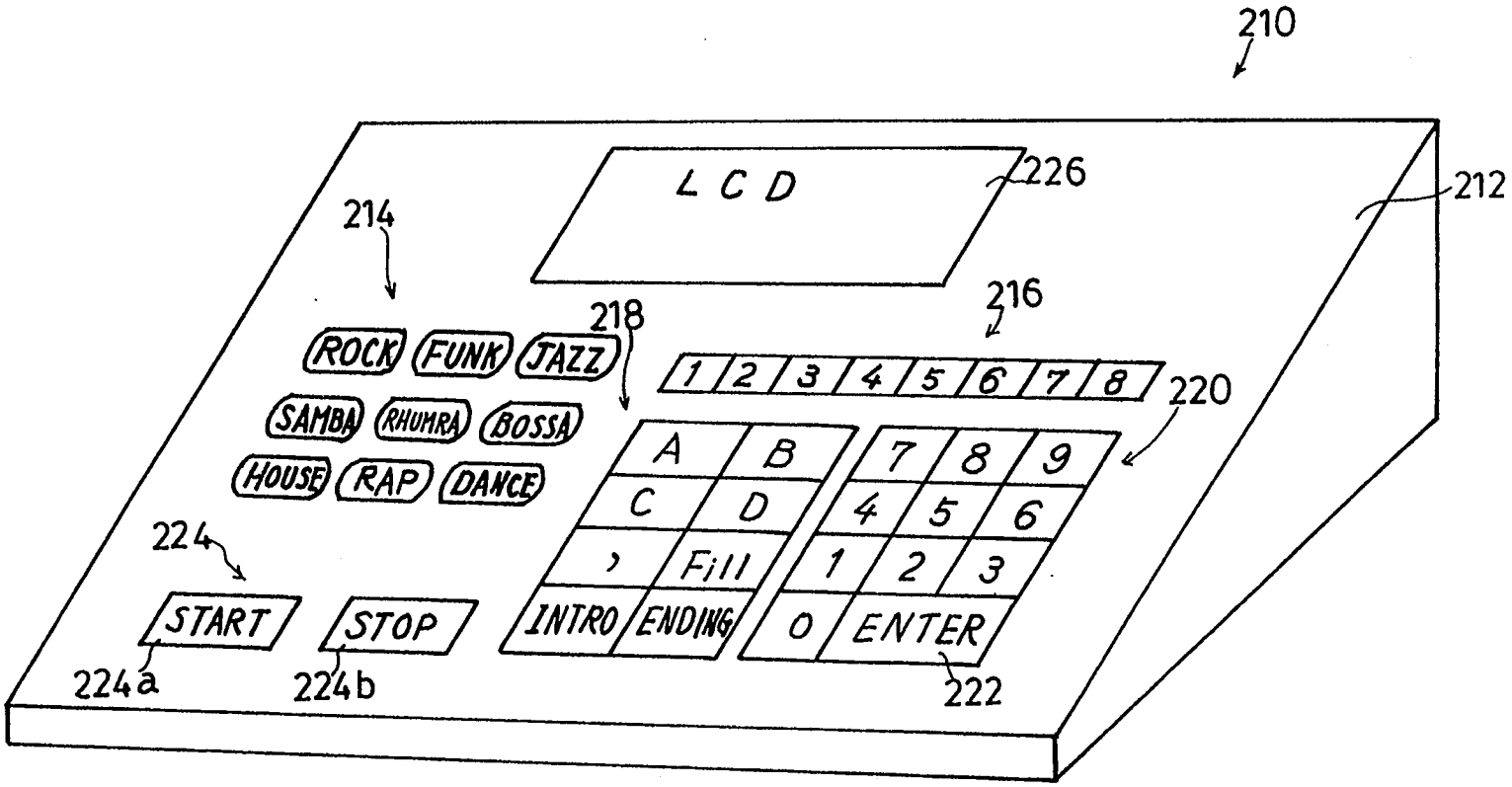
FIG. 23 is a perspective view of a rhythm creating system embodying the present invention.

FIG. 23 shows the appearance of a rhythm creating system capable of creating a rhythm pattern for an entire piece of music, embodying the present invention in a perspective view.

The rhythm creating system 210 has a control panel 212 provided with a plurality of genre selection keys 214 for selecting genres of music including rock 'n' roll music (ROCK), funk music (FUNK), jazz music (JAZZ) and samba music (SAMBA), level input keys 216 for specifying the level (complexity) of a rhythm pattern to be created, part name input keys 218, numeric keys 220 and an enter key 222. One of the part name input keys 218 is pushed to specify the part of a piece of music for which a rhythm pattern is to be created, the numeric keys 220 are operated to specify the number of bars of the part, and the enter key 222 is pushed to enter the information specified by pushing the part name input key 218. Musical play control keys 224, i.e., a start key **224*a* and a stop key 224*b*, are arranged in the left-hand lower corner of the control panel 212. When the start key 224*a* is pushed, a rhythmic sound created on the basis of the input information is sounded automatically until the stop key 224*b*** is pushed.

A liquid crystal display (LCD) 226 is disposed in the upper portion of the control panel 212 to display information of assistance in operating the keys and information entered by operating the keys.

Figure 24:
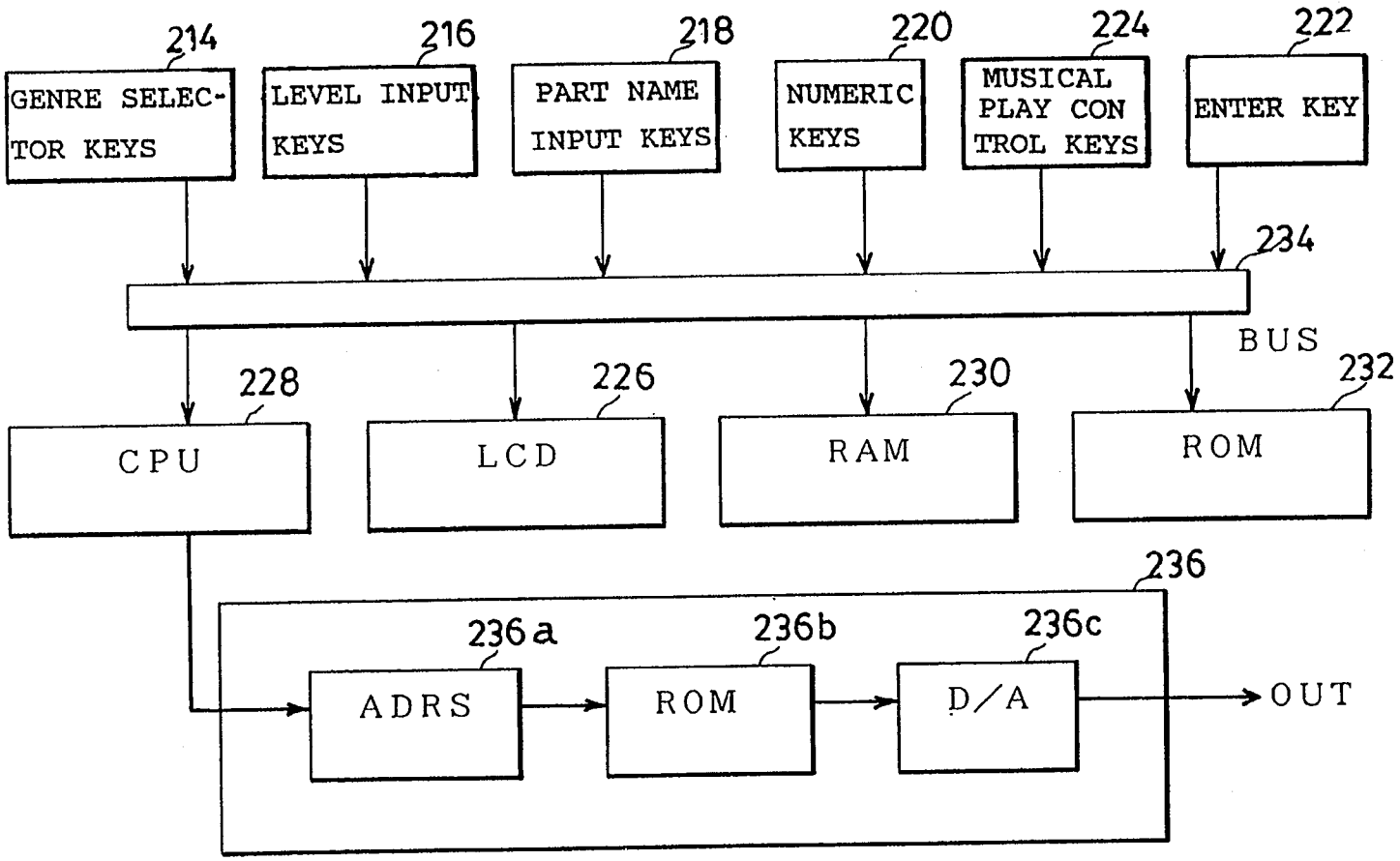
FIG. 24 is a block diagram of the rhythm creating system shown in FIG. 23.

FIG. 24 is a block diagram of the circuit of the rhythm creating system of FIG. 23, in which component circuits corresponding to the components shown in FIG. 23 are denoted by the same reference characters and the description thereof will be omitted.

Referring to FIG. 24, the rhythm creating system 210 is provided with a CPU 228, a RAM 230 and a ROM 232. Programs stored in the ROM 232 are executed sequentially by the CPU 228. The RAM 230 serves as a work area. The CPU 258, the RAM 230, the ROM 232, the switches operated by the keys 214, 216, 218, 220, 222 and 224, and the LCD are interconnected by a bus line 234.

Generated rhythm patterns are stored temporarily in the RAM 230. The rhythm patterns are transferred sequentially to a sound source unit 236 after the start key **224*a* (FIG. 23) has been pushed. The sound source unit 236 is provided with a ROM 236*b* storing digital musical waveforms of sounds created by rhythm instruments, such as a bass drum, a snare drum, open high-hat cymbals, closed high-hat cymbals and the like, and an address generator 236a for addressing the ROM 236b. The rhythm patterns given sequentially to the sound source unit 236 by the CPU 228 are converted into address signals specifying addresses in the ROM 236b by the address generator 236a, and the digital musical waveforms are read according to the address signals from the ROM 236b. The digital musical waveforms are converted into analog musical waveform by a DA converter 236c, and a low-pass filter, not shown, removes noise from the analog musical waveform before the rhythm creating system 210** gives the analog musical waveforms to an amplifier, not shown. The amplified analog musical waveforms are applied to a loudspeaker, not shown, which sounds rhythm of the analog musical waveforms.

Figure 25:
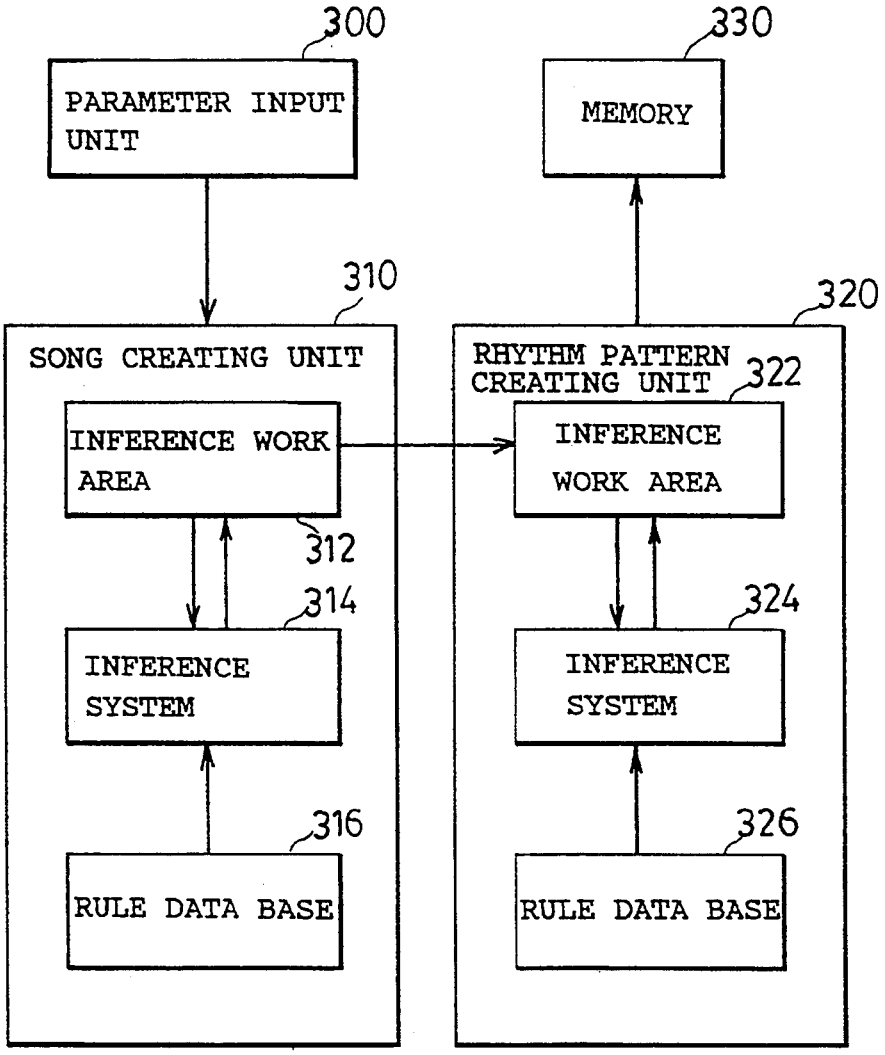
FIG. 25 is a block diagram of the rhythm creating system shown in FIGS. 23 and 24, showing the functional elements of the rhythm creating system in a configuration corresponding to a rhythm pattern creating algorithm to be executed by the rhythm creating system.

FIG. 25 shows the rhythm creating system of FIGS. 23 and 24 in a configuration corresponding to a rhythm pattern creating algorithm.

A parameter input unit 300, i.e., an instruction input means, corresponds to the keys 214, 216, 218, 220 and 222 of FIGS. 23 and 24. The parameter input unit 300 is operated to enter parameters specifying a genre of a piece of music for which a rhythm pattern is to be created by the rhythm creating system 210, a level (complexity), part names and the number of bars of each part. The input parameters are stored in a parameter storage area of the RAM 230.

A song creating unit 310 shown in FIG. 25, i.e., a parameter extracting means, comprises an inference work area 312 of the RAM 230, an inference unit 314 consisting of programs to be executed by the CPU 228, and a rule data base 316 stored in the ROM 232.

Parameters created by the song creating unit 310 are given to a pattern creating unit 320, i.e., a rhythm pattern creating means. The pattern creating unit 320, which is similar in structure to song creating unit 310, comprises an inference work area 322 of the RAM 230, an inference system 324 consisting of programs to be executed by the CPU 228, and a rule data base 326 stored in the ROM 232. Rhythm patterns created for an entire piece of music by the pattern creating unit 320 are stored in a memory 330.

The rhythm patterns stored in the memory 330 are transferred sequentially to the sound source unit 236 when the start key 224a is pushed, and sounds of the rhythm patterns are sounded by a loudspeaker, not shown.

FIG. 26 shows, by way of example, parameters provided by the parameter input unit 300, FIG. 27 shows, by way of example, song creating rules included in the rule data base 316, and FIG. 28 shows, by way of example, the result of inference made by the song creating unit 310. An inference system included in the song creating unit 310 will be described hereinafter with reference to FIGS. 26 to 28.

Parameters as shown in FIG. 26 provided by the parameter input unit 300 are stored as facts in the inference work area 312. The parameters in this example specify rock 'n' roll music (ROCK) as a genre, a level (complexity) "1", which indicates a simplest rhythm pattern, an introduction part (INTRO) of four bars, a part A of four bars, a part A' (a part having rhythm slightly different from that of the part A) of four bars, a part B of eight bars, a part C of eight bars, a part B' (a part having rhythm similar to that of the part B) of eight bars, a part C' (a part having the same rhythm as that of the part C) of sixteen bars and an ending part (ENDING) of two bars. The rhythm creating system is able to create rhythm patterns for an entire piece of music when only the genre of the piece of music and information representing the melody of the entire piece of music are specified and given thereto.

A fact "ROCK" among those shown in FIG. 26 is extracted, reference is made to the song creating rules (FIG. 27) included in the rule data base 316 to search conditional parts starting with "IF" for a character string "ROCK". In this example, the character string "ROCK" is found in step c. Then, a decision part "TIME=8/8" starting with "THEN" is stored as a new fact in the inference work area 312. For example, if "INTRO" is extracted as a fact, the song creating rules are searched for a character string "INTRO". In this example, the character string "INTRO" is found in steps a, a+1, a+2 and a+3. The number of bars "4" is extracted as the next fact to employ the rule of step a+3 and "IDEA 3" in the rule C of step a+3 is stored as a new fact in the inference work area 312. Since the number of bars of "INTRO" is "4", step d also conforms to the condition. Since the decision part of step d is "JOB1", "JOBI" of step f is executed to reduce the number of bars of the introduction part to "3" by subtracting "1" from the number "4" of bars of the introduction part, and step f+1 is executed to insert one bar of a fill-in part "Fill" in a position next to the three bars of the introduction part by the same parameter as that of the introduction part. This inserted fill-in part "Fill" is designated as "Fill INTRO", which corresponds to "Fill I" shown in FIG. 28.

Reference is thus made to the song creating rules (FIG. 27) to obtain inference data created by reference and consisting of choices of the parameters as shown in FIG. 28. The inference data is stored as facts in the inference work area 322 of the pattern creating unit 320.

FIG. 29 shows, by way of example, pattern creating rules included in the rule data base 326 of the pattern creating unit 320, and FIG. 30 shows, by way of example, inference data created through inference by the pattern creating unit 320. An example of an inference system of the pattern creating unit 320 will be described hereinafter with reference to FIGS. 29 and 30.

After the inference data (FIG. 28) created by the song creating unit 310 has been stored as facts in the inference work area 322 of the pattern creating unit 320, one of the facts, for example, a fact "INTRO", is extracted, and then the pattern creating rules (FIG. 29) are searched. Since the 1st pattern creating rule has "Part=INTRO", the decision part "COUNT" starting with "THEN" is stored as a new fact in the inference work area 322.

When the "COUNT" stored as an interim decision is extracted as a fact after the extraction of a fact and the search of the pattern creating rules has been repeated several times, the pattern creating rules are searched for "COUNT". In this example, "COUNT" is found in the 26th pattern creating rule, the decision part "RIM=8888" of the 26th pattern creating rule is stored in the inference work area 322. Then, "Fill I" among the facts shown in FIG. 28 is extracted, and then the pattern creating rules (FIG. 29) are searched. Fill I is found in the 2nd to 9th pattern creating rules. Since the fact corresponding to the "Fill I" is "Level=1", the 2nd pattern creating rule is selected and the decision part "Snare 1" of the 2nd pattern creating rule is stored as a new fact (interim decision) in the inference work area 322. Since the fact "Idea=3" corresponds to Fill I, the 7th pattern creating rule is employed and the decision part "SNARE & KICK" of the 7th pattern creating rule is stored as a new fact (interim decision).

The "SNARE 1" is extracted as a fact after the extraction of a fact and the search of the pattern creating rules has been repeated several times. In this example, since the 33rd pattern creating rule has "SNARE 1", the decision part "SNARE=080A" of the 33rd pattern creating rule is stored as a fact. When "SNARE & KICK 3" is extracted as a fact, the decision part "SWAP SNARE & KICK=3330" of the 42nd pattern creating rule is stored as a new fact.

The inference system 324 of the pattern creating unit 320 (FIG. 25) repeats the foregoing procedure to obtain inference data as shown in FIG. 30, in which only a portion of the inference data is shown. The inference system 324 creates the following bit rhythm patterns on the basis of inference data shown in FIG. 30.

FIG. 31 is a view of assistance in explaining bit rhythm pattern creation and FIG. 32 shows created rhythm patterns represented by musical notes.

A bit rhythm pattern "1000100010001000" as shown in FIG. 31 is created from one data "INTRO→RIM=8888" among those shown in FIG. 30 obtained by inference. Since the part INTRO has three bars, (four bars were specified initially for the part INTRO and one of the four bars was changed for the fill-in part "Fill I"), this rhythm pattern "1000100010001000" is repeated for the initial three bars corresponding to the part INTRO as shown in FIG. 32.

A bit rhythm pattern "0000100000001010" for the SNARE as shown in FIG. 31 is created first from data "Fill A→SNARE=080A, SWAP SNARE&KICK-0820" shown in FIG. 30 obtained by inference. Bits among this bit rhythm pattern corresponding to the code "1" in a bit rhythm pattern "0000100000100000" for SWAP are changed for KICK to create a bit rhythm pattern "0000000000001010" for SNARE and a bit rhythm pattern "0000100000000000" for KICK, for the last four bars of a bit rhythm pattern for the part A as shown in FIG. 32. Thus, rhythm patterns as shown in FIG. 32 are created for the entire piece of music and are stored temporarily in the memory 330. When the start key 224*a* is pushed, the rhythm patterns are read sequentially and transferred to the sound source unit 236 (FIG. 24) and are sounded repeatedly by the loudspeaker, not shown, until the stop key 224*b* is pushed.

What is claimed is:

1. A rhythm pattern creating system comprising:

a first memory storing a first rule data base for associating the melody of a piece of music with the choices of a plurality of parameters specifying the features of a desired rhythm;

a second memory storing a second rule data base for associating the choices of the plurality of parameters with a plurality of rhythm patterns;

an instruction input means for entering information representing the melody of a desired piece of music and a plurality of parameters specifying the features of a desired rhythm pattern to be created corresponding to the entered melody;

a parameter extracting means for extracting the predetermined choices of at least some of the plurality of parameters for each part of the desired piece of music with reference to the first rule data base stored in the first memory, on the basis of information representing the melody of the desired piece of music; and a rhythm pattern creating means for creating rhythm patterns for the entire piece of music by creating rhythm patterns for each part of the desired piece of music with reference to the second rule data base stored in the second memory, on the basis of the predetermined choices extracted by the parameter extracting means for each part of the desired piece of music.

2. A rhythm pattern creating system according to claim 1, wherein said instruction input means enters information specifying the genre of the rhythm of the desired piece of music in addition to the information representing the melody of the desired piece of music.

3. A rhythm creating system according to claim 2, wherein said instruction input means further enters information representing the level of complexity of the rhythm of the desired piece of music.

* * * * *